US008063587B2

(12) United States Patent
Yang

(10) Patent No.: US 8,063,587 B2
(45) **Date of Patent: *Nov. 22, 2011**

(54) BI-DIRECTIONAL LIGHT EMITTING DIODE DRIVE CIRCUIT IN BI-DIRECTIONAL POWER PARALLEL RESONANCE

(76) Inventor: Tai-Her Yang, Dzan-Hwa (TW)

( * ) Notice: Subject to any disclaimer, the term of this patent is extended or adjusted under 35 U.S.C. 154(b) by 312 days.

This patent is subject to a terminal disclaimer.

(21) Appl. No.: 12/351,921

(22) Filed: Jan. 12, 2009

(65) Prior Publication Data

US 2009/0179594 A1 Jul. 16, 2009

Related U.S. Application Data

(60) Provisional application No. 61/020,829, filed on Jan. 14, 2008.

(51) Int. Cl.
*H05B 41/36* (2006.01)

(52) U.S. Cl. ..... 315/307; 315/250; 315/291

(58) Field of Classification Search ..... 315/246, 315/248, 250, 258, 283, 290, 291, 297, 307, 315/227 R, 228, 239, 244, 276
See application file for complete search history.

(56) References Cited

U.S. PATENT DOCUMENTS

| | | | | |
|---|---|---|---|---|
| 5,247,238 | A * | 9/1993 | Yang | 320/142 |
| 6,628,085 | B2 * | 9/2003 | Yang | 315/169.3 |
| 7,164,237 | B2 * | 1/2007 | Van Casteren | 315/209 R |
| 7,489,086 | B2 * | 2/2009 | Miskin et al. | 315/185 R |
| 7,564,198 | B2 * | 7/2009 | Yamamoto et al. | 315/307 |
| 7,868,561 | B2 * | 1/2011 | Weightman et al. | 315/294 |
| 2006/0197466 | A1 * | 9/2006 | Park | 315/224 |
| 2008/0211421 | A1 * | 9/2008 | Lee et al. | 315/250 |
| 2008/0231204 | A1 * | 9/2008 | Praiswater et al. | 315/192 |

* cited by examiner

*Primary Examiner* — Shawki S Ismail
*Assistant Examiner* — Crystal L Hammond
(74) *Attorney, Agent, or Firm* — Rabin & Berdo, P.C.

(57) ABSTRACT

The present invention uses the capacitive, or inductive, or resistive impedance component to constitute the first impedance, and the parallel connected capacitive and the inductive impedance components in parallel resonance to constitute the second impedance; and is characterized as that the first impedance and the second impedance in series connection is configured for inputting bi-directional power, thereby dividing its power source voltage to drive the bi-directional conducting light emitting diode.

25 Claims, 9 Drawing Sheets

BI-DIRECTIONAL LIGHT EMITTING DIODE DRIVE CIRCUIT IN BI-DIRECTIONAL POWER PARALLEL RESONANCE

BACKGROUND OF THE PRESENT INVENTION (a) Field of the Present Invention

The bi-directional light emitting diode drive circuit in bi-directional power parallel resonance is disclosed by that a bi-directional power is used as the power source which is supplied to a first impedance which is constituted by a capacitive impedance component, or an inductive impedance component or a resistive impedance component as well as to a second impedance which is constituted by a capacitive impedance component and an inductive impedance component in parallel connection, whereby the inherent parallel resonance frequency of the second impedance is the same as the frequency of the bi-directional power source such as the frequency of an AC power, or the periodically alternated polarity power converted from the DC power to produce a parallel resonance status through the bi-directional power input. Thereof it is characterized in that the first impedance and the second impedance are series connected to receive a bi-directional power, whereby the power source voltage of the said bi-directional power is divided by the series connected first impedance and second impedance in parallel resonance to form a divided power for driving the bi-directional conducting light emitting diode.

(b) Description of the Prior Art

The conventional light emitting diode drive circuit using AC or DC power source is usually series connected with current limit resistors as the impedance to limit the current to the light emitting diode, whereof the voltage drop of the series connected resistive impedance always result in waste of power and accumulation of heat which are the imperfections.

SUMMARY OF THE PRESENT INVENTION

The present invention is disclosed by that a first impedance is constituted by a capacitive impedance component, or an inductive impedance component or a resistive impedance component and a second impedance is constituted by a capacitive impedance component and an inductive impedance component in parallel connection, whereof the inherent parallel resonance frequency of the second impedance is the same as the frequency of the bi-directional power source such as the frequency of an AC power, or the alternated polarity period of the constant or variable voltage and constant or variable periodically alternated polarity power converted from a DC power, thereby to produce a parallel resonance status.

The two ends of the first impedance and the second impedance in series connection are provided with a bi-directional power input, whereby a divided power is formed at the first impedance and a divided power in parallel resonance is formed at the second impedance, thereof at least one bi-directional conducting light emitting diode set is driven by the divided power across the two ends of the first impedance or the divided power in parallel resonance across the two ends of the second impedance to emit light.

DESCRIPTION OF MAIN COMPONENT SYMBOLS

Figure 1:
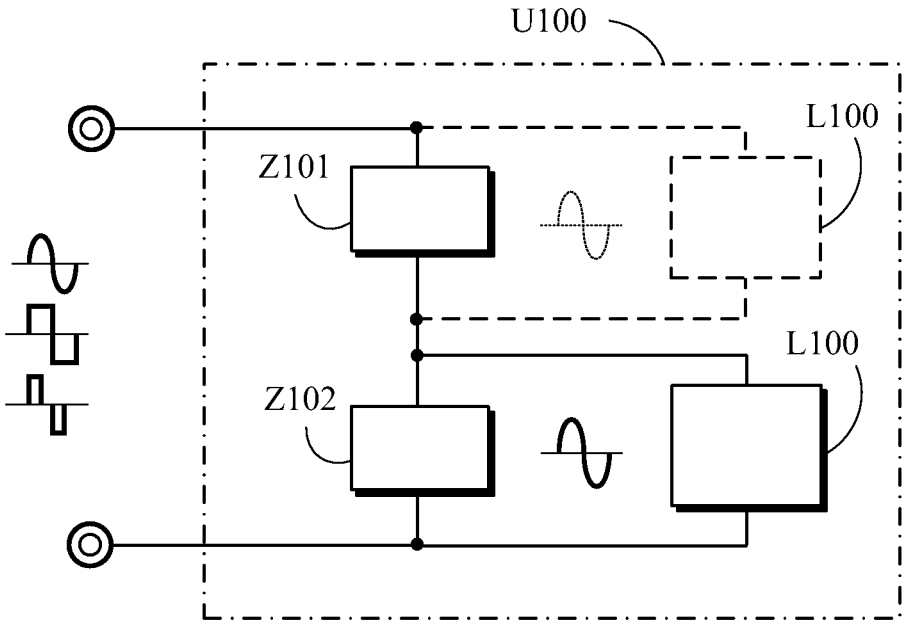
FIG. 1 is the schematic block diagram of the bi-directional light emitting diode drive circuit in bi-directional power parallel resonance.

C100, C200: Capacitor
CR100, CR101, CR102, CR201, CR202: Diode
ESD101, ESD102: Charge/discharge device
I100, I103, I104, I200: Inductive impedance component
IT200: Separating type transformer
L100: Bi-directional conducting light emitting diode set
LED101: First light emitting diode
LED102: Second light emitting diode
R101: Discharge resistor
R100, R103, R104: Current limit resistor
ST200: Self-coupled transformer
U100: Bi-directional light emitting diode (LED) drive circuit
W0: Self-coupled voltage change winding
W1: Primary side winding
W2: Secondary side winding
Z101: First impedance
Z102: Second impedance
ZD101, ZD102: Zener Diode
300: Bi-directional power modulator of series connection type
400: Bi-directional power modulator of parallel connection type
500: Impedance component
600: Switching device
4000: DC to AC Inverter

DETAILED DESCRIPTION OF THE PREFERRED EMBODIMENTS

The bi-directional light emitting diode drive circuit (U100) of the bi-directional light emitting diode drive circuit in bi-directional power parallel resonance, in which at least one capacitive impedance component, or inductive impedance component or resistive impedance component constitute at least one first impedance;

Further, at least one capacitive impedance component and at least one inductive impedance component are in parallel connection to constitute the second impedance, whereof the inherent parallel resonance frequency of the second impedance is the same as the frequency or period of the bi-directional power, thereby to produce a parallel resonance status;

The first impedance and the second impedance are in mutual series connection to receive the following bi-directional powers which includes the following:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

It is further installed with a bi-directional conducting light emitting diode set (L100) which is constituted by at least one first light emitting diode (LED101) and at least one second light emitting diode (LED102) in parallel connection of opposite polarities, whereof the number of the first light emitting diode (LED101) and the second light emitting diode (LED102) can be the same or different, further, the first light emitting diode (LED101) and the second light emitting diode (LED102) can be individually constituted by a forward current polarity light emitting diode; or two or more than two forward current polarity light emitting diodes in series or parallel connections; or three or more than three forward current polarity light emitting diodes in series or parallel connections or in series and parallel connections.

The bi-directional conducting light emitting diode set (L100) can be optionally installed with one or more than one sets as needed, whereof it is parallel connected across the two ends of both or either of the first impedance (Z101) or the second impedance (Z102) to form the divided power at the two ends of the first impedance (Z101) and the second impedance (Z102) respectively by the power input, whereby to drive the bi-directional conducting light emitting diode set (L100) to emit light, thus to constitute the bi-directional light emitting diode drive circuit in bi-directional power parallel resonance of the present invention.

FIG. 1 is the schematic block diagram of the bi-directional light emitting diode drive circuit in bi-directional power parallel resonance, in which the circuit function is operated through the bi-directional light emitting diode drive circuit (U100) as shown in FIG. 1, whereof it is mainly comprised of that:

The first impedance (Z101) includes:

(1) The first impedance (Z101) is constituted by at least one capacitor (C100) or at least one inductive impedance component or at least one resistive impedance component, or one kind or more than one kind and one or more than one said impedance components, or by two or more than two kinds of impedance components, whereof the impedance components are respectively one or more than one in series connection or parallel connection, or series and parallel connection, whereby to provide DC or AC impedances; or (2) The first impedance (Z101) is constituted by at least one capacitive impedance component and at least one inductive impedance component in mutual series connection, whereof their inherent series resonance frequency after series connection is the same as the frequency of bi-directional power source such as the frequency of an AC power, or the alternated polarity period of the constant or variable periodically alternated polarity power converted from the DC power, thereby to produce a series resonance status; or (3) The first impedance (Z101) is constituted by at least one capacitive impedance component and at least one inductive impedance component in mutual parallel connection, whereof the inherent parallel resonance frequency after parallel connection is the same as the frequency of bi-directional power source such as the frequency of an AC power, or the alternated polarity period of the constant or variable periodically alternated polarity power converted from the DC power, thereby to produce a low energy consuming alternated polarity power storage status at parallel resonance frequency and to appear a divided end voltage status corresponding to the second impedance.

The second impedance (Z102) includes:

It is constituted by at least one inductive impedance component (I200) and at least one capacitor (C200) in parallel connection, whereof its frequency is the same as the frequency of the bi-directional power source such as the frequency of an AC power, or the alternated polarity period of the constant or variable voltage and the constant or variable periodically alternated polarity power converted from a DC power to appear in a parallel resonance status, thereby to present a divided end voltage status corresponding to the first impedance.

At least one of the three kinds of the capacitive impedance components, inductive impedance components or resistive impedance components can be optionally selected as needed to constitute the first impedance (Z101) in the bi-directional light emitting diode drive circuit in bi-directional power parallel resonance;

The first impedance (Z101) in the bi-directional light emitting diode drive circuit in bi-directional power parallel resonance can also be selected not to use, instead of that, the second impedance (Z102) which is in parallel resonance with the bi-directional power from power source is directly parallel connected with the power source of bi-directional power;

At least one first impedance (Z101) and at least one second impedance (Z102) are in mutual series connection, whereof the two ends of the first impedance (Z101) and the second impedance (Z102) in mutual series connection are provided to receive the following bi-directional powers:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

A bi-directional conducting light emitting diode set (L100): It is constituted by at least one first light emitting diode (LED101) and at least one second light emitting diode (LED102) in parallel connection of opposite polarities, whereof the number of first light emitting diodes (LED101) and the number of second light emitting diodes (LED102) can be the same or different, and the first light emitting diode (LED101) and the second light emitting diode (LED102) are individually constituted by a forward current polarity light emitting diode, or by two or more than two forward current polarity light emitting diodes in series connection or parallel connection, or by three or more than three forward current polarity light emitting diodes in series connection, parallel connection or series and parallel connection;

One or more than one set of the bi-directional conducting light emitting diode set (L100) can be optionally selected as needed to be parallel connected across the two ends of both or either of the first impedance (Z101) or the second impedance (Z102), whereof the divided power is formed across the two ends of first impedance (Z101) and the two ends of second impedance (Z102) by means of power input, whereby to drive the bi-directional conducting light emitting diode set (L100) which is parallel connected across the two ends of the first impedance (Z101) or the two ends of the second impedance (Z102) to emit light.

The bi-directional light emitting diode drive circuit (U100) in the bi-directional light emitting diode drive circuit in bi-directional power parallel resonance of the present invention, in which the first impedance (Z101) and the second impedance (Z102) as well as the bi-directional conducting light emitting diode set (L100) can be selected to be one or more than one as needed.

Figure 2:
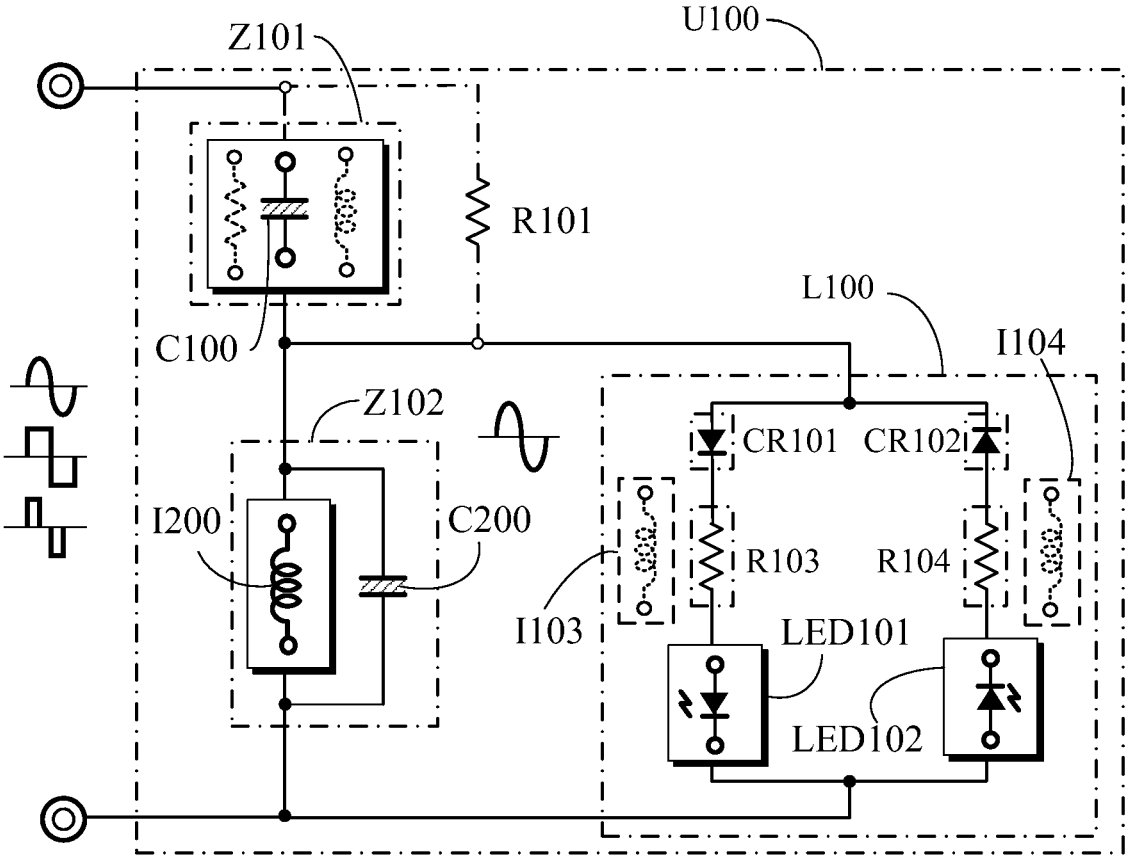
FIG. 2 is the circuit example schematic diagram of the present invention.

The said bi-directional light emitting diode drive circuit of bi-directional power in parallel resonance can be optionally installed with capacitive, inductive or resistive impedance components as needed, whereof the first impedance (Z101) can be constituted by at least one of the three types of impedance components or the first impedance (Z101) can be selected not to use, instead of that, the second impedance (Z102) is directly parallel connected with the power source of a bi-directional power. Herein it is described in the following:

For convenience of description, the components listed in the circuit examples of the following exemplary embodiments are selected as in the following:

(1) A first impedance (Z101) and a second impedance (Z102) as well as a bi-directional conducting light emitting diode set (L100) are installed in the embodied examples. Nonetheless, the selected quantities are not limited in actual applications;

(2) The capacitive impedance of the capacitor is selected to represent the impedance components, thereby to constitute the first impedance (Z101) and second impedance (Z102) in the embodied examples, whereof the capacitive, inductive and/or resistive impedance components can be optionally selected as needed in actual applications, whereby it is described in the following:

FIG. 2 is a circuit example schematic diagram of the present invention which is comprised of the following:

A first impedance (Z101): it is constituted by at least one capacitor (C100) with especially referring to a bipolar capacitor, whereof the number of the first impedances can be one or more than one, or the first impedance (Z101) can be optionally selected as needed not to use;

A second impedance (Z102): It is constituted by at least one inductive impedance component (I200) and at least one capacitor (C200) in parallel connection with especially referring to be constituted by an inductive impedance component and a bipolar capacitor, so that its frequency is the same as the frequency of the bi-directional power such as the frequency of an AC power, or the alternated polarity period of the constant or variable voltage and the constant or variable periodically alternated polarity power converted from a DC power to appear in a parallel resonance status. Further, the number of the second impedances can be one or more than one;

At least one first impedance (Z101) and at least one second impedance (Z102) are in series connection while the two ends of the said series connection is provided with a bi-directional power input, thereby to form a divided power in parallel resonance at the second impedance (Z102), and at least one bi-directional conducting light emitting diode set (L100) is driven by the said divided power;

A bi-directional conducting light emitting diode set (L100): it is constituted by at least one first light emitting diode (LED101) and at least one second light emitting diode (LED102) in parallel connection of opposite polarities, whereof the number of the first light emitting diode (LED101) and the number of the second light emitting diode (LED102) can be the same or different, further, the first light emitting diode (LED101) and the second light emitting diode (LED102) can be individually constituted by a forward current polarity light emitting diode; or two or more than two forward current polarity light emitting diodes in series or parallel connections; or three or more than three forward current polarity light emitting diodes in series or parallel connections or in series and parallel connections. The bi-directional conducting light emitting diode set (L100) can be optionally installed with one or more than one sets as needed, whereof it is parallel connected across the two ends of both or either the first impedance (Z101) or the second impedance (Z102) to form the divided power which is used to drive the bi-directional conducting light emitting diode set (L100) to emit light; or At least one bi-directional conducting light emitting diode set (L100) is parallel connected across the two ends of at least one second impedance (Z102), whereby to be driven by the divided power across the two ends of the second impedance (Z102) which is in parallel resonance with the bi-directional power period, while the impedance of the first impedance (Z101) is used to limit its current and in case that the capacitor (C100) (such as a bipolar capacitor) is used as the first impedance component, the output current is then limited by the capacitive impedance;

The first impedance (Z101), the second impedance (Z102) and the bi-directional conducting light emitting diode set (L100) are connected according to the aforesaid circuit structure to constitute the bi-directional light emitting diode drive circuit (U100);

Besides, through the current distribution effect formed by the parallel connection of the bi-directional conducting light emitting diode set (L100) and the second impedance (Z102), the voltage variation rate across the two ends of the bi-directional conducting light emitting diode set (L100) corresponding to power source voltage variation can be reduced;

Selection of the first light emitting diode (LED101) and the second light emitting diode (LED102) which constitute the bi-directional conducting light emitting diode set (L100) in the bi-directional light emitting diode drive circuit (U100) includes the following:

1. A first light emitting diode (LED101) which can be constituted by one light emitting diode, or by more than one light emitting diodes in series connection of forward polarities, or in parallel connection of the same polarity or in series and parallel connection;

2. A second light emitting diode (LED102) which can be constituted by one light emitting diode, or by more than one light emitting diodes in series connection of forward polarities, or in parallel connection of the same polarity or in series and parallel connection;

3. The number of light emitting diodes which constitute the first light emitting diode (LED101) and the number of light emitting diodes which constitute the second light emitting diode (LED102) can be the same or different;

4. If the number of light emitting diodes which constitute either the first light emitting diode (LED101) or the second light emitting diode (LED102) respectively is one or more than one, the connecting relationship of the respective light emitting diodes can be in the same or different series connection, parallel connection or series and parallel connection;

5. Either the first light emitting diode (LED101) or the second light emitting diode (LED102) can be replaced by a diode (CR100), whereof the current direction of the said (CR100) and the working current direction of either the first light emitting diode (LED101) or the second light emitting diode (LED102) which is reserved for parallel connection are in parallel connection of opposite polarities.

Figure 3:
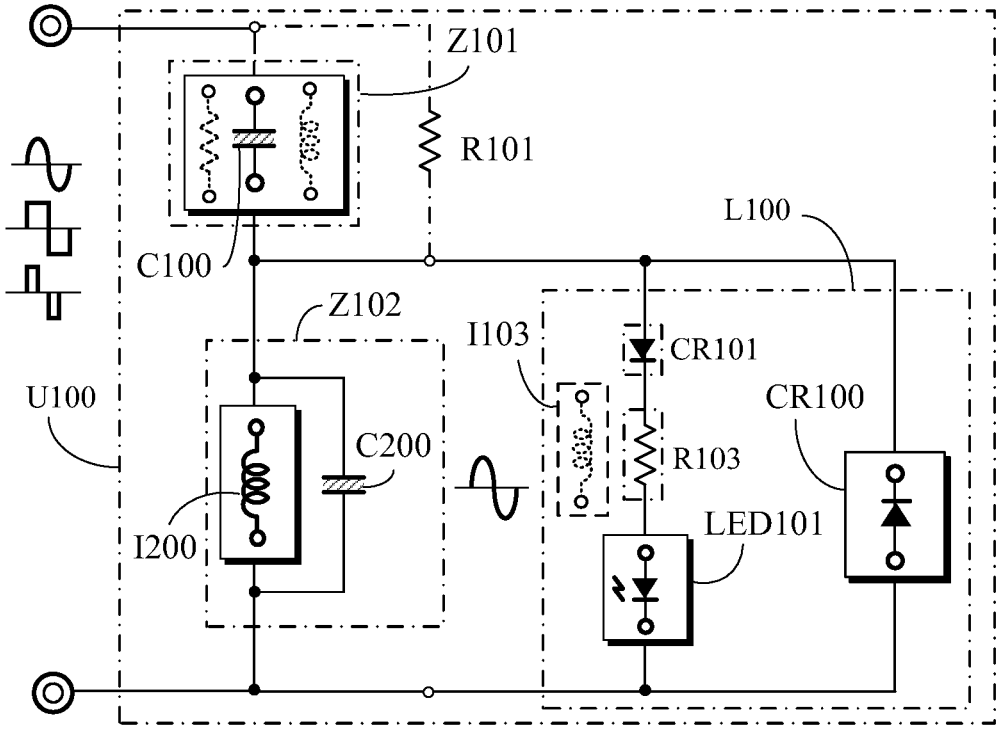
FIG. 3 is a circuit example schematic diagram of the present invention illustrating that the bi-directional conducting light emitting diode set is constituted by a first light emitting diode and a diode in parallel connection of opposite polarities.
Figure 4:
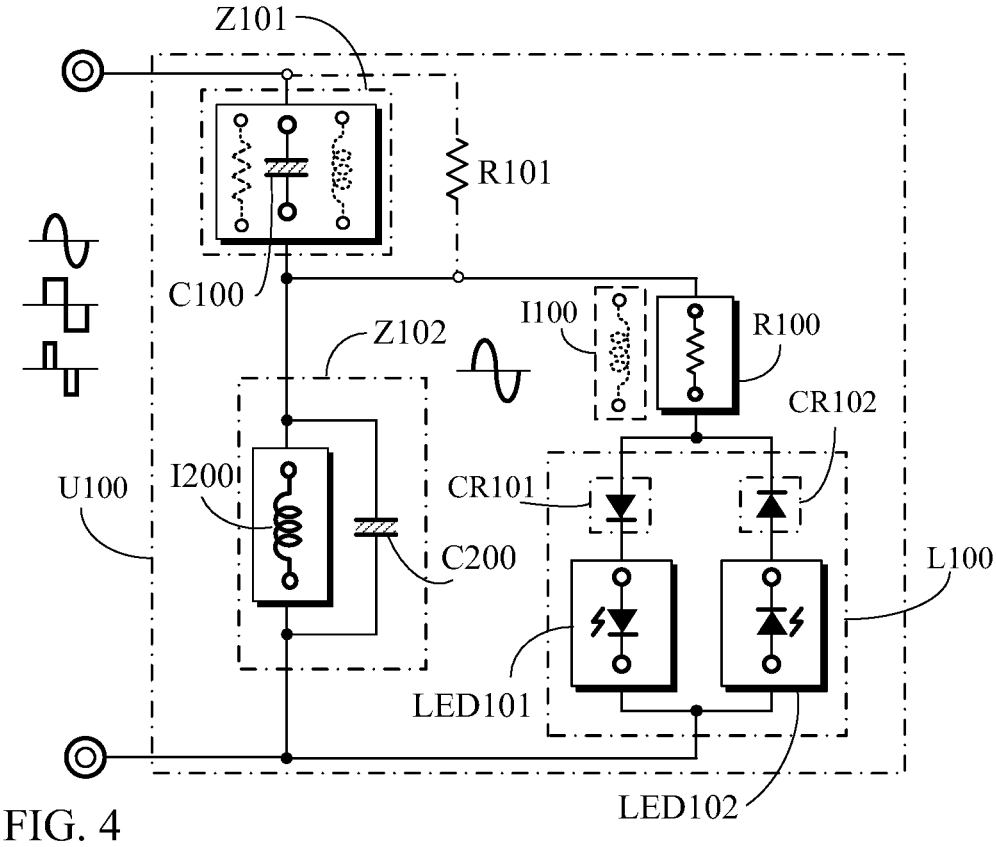
FIG. 4 is a circuit example schematic diagram illustrating that the bi-directional conducting light emitting diode set is series connected with a current limit resistor.
Figure 5:
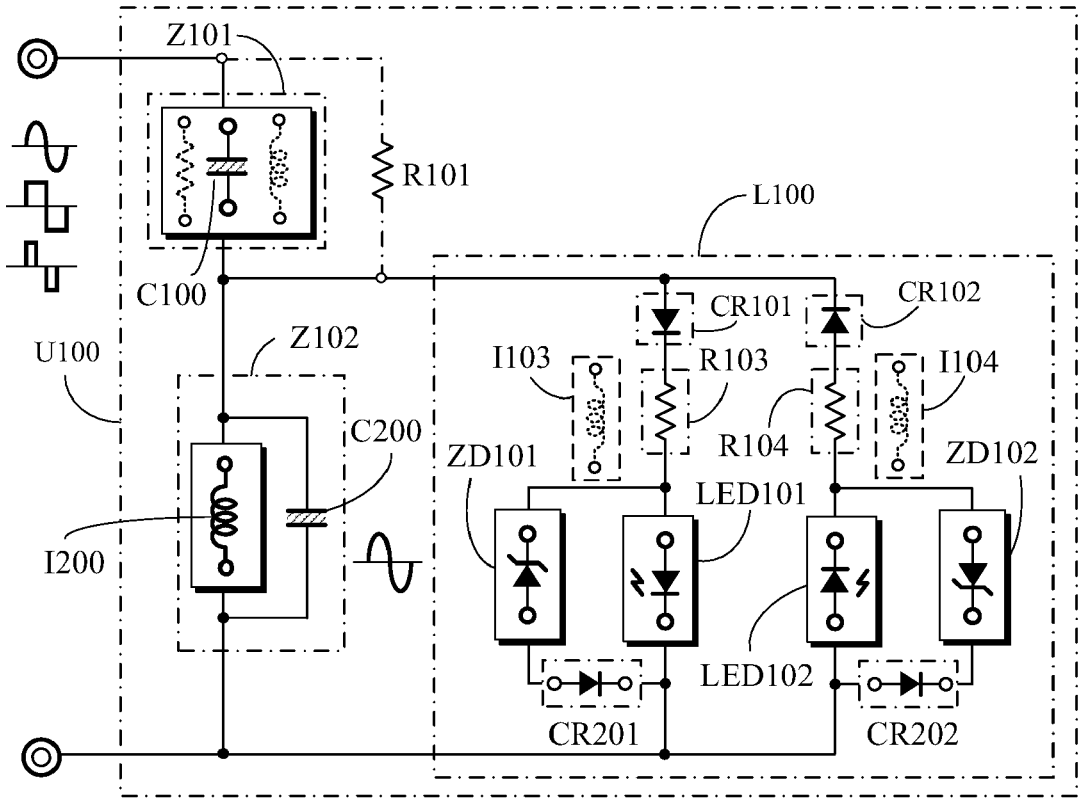
FIG. 5 is a circuit example schematic diagram illustrating that the bi-directional conducting light emitting diode set in the circuit of FIG. 2 is further installed with a zener diode.
Figure 6:
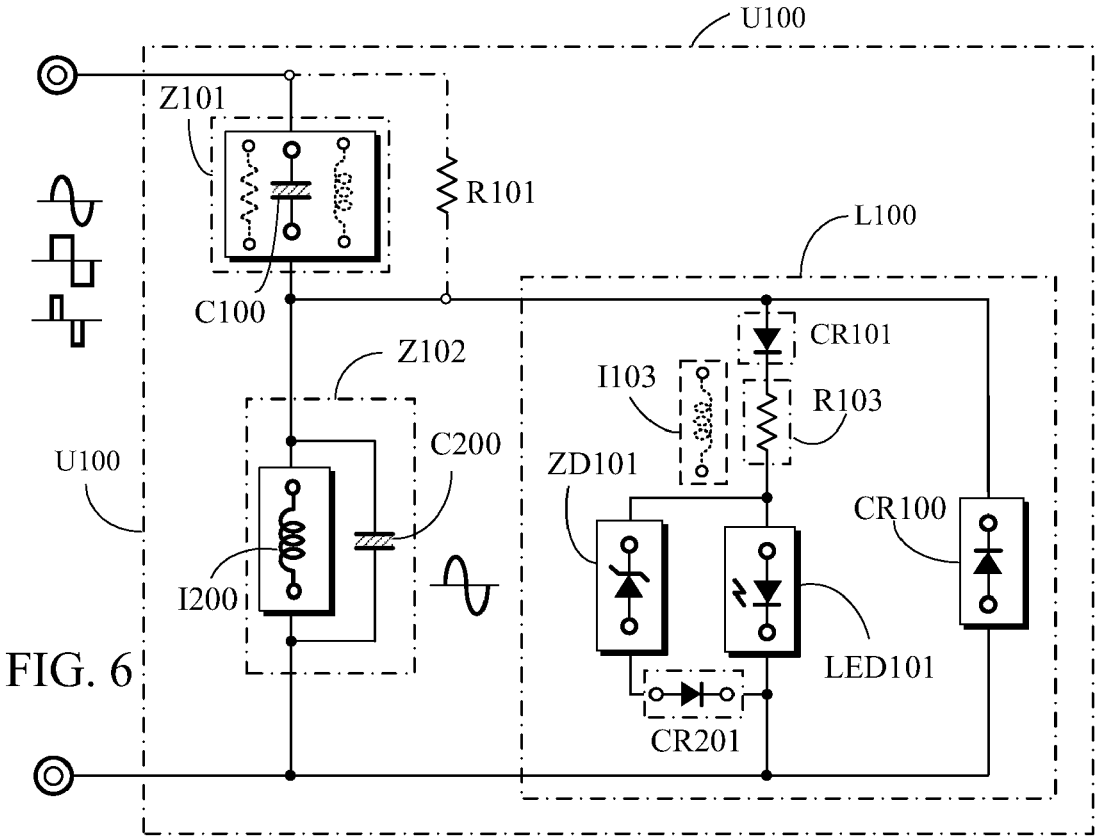
FIG. 6 is a circuit example schematic diagram illustrating that the bi-directional conducting light emitting diode set in the circuit of FIG. 3 is further installed with a zener diode.

FIG. 3 is a circuit example schematic diagram of the present invention illustrating that the bi-directional conducting light emitting diode set is constituted by a first light emitting diode and a diode in parallel connection of opposite polarities;

The bi-directional light emitting diode drive circuit in bi-directional power parallel resonance is operated through the circuit function of the bi-directional light emitting diode drive circuit (U100), whereof in actual applications, as shown in FIGS. 1, 2 and 3, the following auxiliary circuit components can be optionally selected as needed to be installed or not installed while the quantity of the installation can be constituted by one or more than one, whereof in case more than one are selected, they can be selected based on circuit function requirements to be in series connection or parallel connection or series and parallel connection in corresponding polarities, whereof the optionally selected auxiliary circuit components include:

A diode (CR101): It is optionally installed as needed to series connect with the first light emitting diode (LED101) to avoid reverse over-voltage;

A diode (CR102): It is optionally installed as needed to series connect with the second light emitting diode (LED102) to avoid reverse over-voltage;

A discharge resistor (R101): It is an optionally installed component, in case the capacitor (C100) (such as a bipolar capacitor) is selected for the first impedance (Z101), it is parallel connected across the two ends of the capacitor (C100) of the first impedance (Z101) to release the residual charge of the capacitor (C100);

A current limit resistor (R103): It is an optionally installed component as needed to individually series connect with each of the first light emitting diodes (LED101) of the bi-directional conducting light emitting diode set (L100), whereby it is used to limit the current passing through the first light emitting diode (LED101); whereof the current limit resistor (R103) can also be replaced by an inductive impedance component (I103);

A current limit resistor (R104): It is an optionally installed component as needed to individually series connect with each of the second light emitting diodes (LED102) of the bi-directional conducting light emitting diode set (L100), whereby it is used to limit the current passing through the second light emitting diode (LED102); whereof the current limit resistor (R104) can also be replaced by an inductive impedance component (I104);

The current limit resistors (R103) and (R104) can be respectively installed to the first light emitting diode (LED101) and the second light emitting diode (LED102) of the bi-directional conducting light emitting diode set (L100) simultaneously in the bi-directional light emitting diode drive circuit (U100), or they can be replaced by or installed together with a current limit resistor (R100) to directly series connect with the bi-directional conducting light emitting diode set (L100) to obtain the current limit function, whereof the current limit resistor (R100) can also be replaced by an inductive impedance component (I100). The bi-directional light emitting diode drive circuit (U100) is thus constituted by the said circuit structure and selection of auxiliary circuit components; as shown in FIG. 4 which is a circuit example schematic diagram illustrating that the bi-directional conducting light emitting diode set is series connected with a current limit resistor;

In addition, for protecting the light emitting diode and to avoid the light emitting diode being damaged or reduced working life by abnormal voltage, a zener diode can be further parallel connected across the two ends of the first light emitting diode (LED101) and the second light emitting diode (LED102) in the bi-directional conducting light emitting diode set (L100) of the bi-directional light emitting diode drive circuit (U100) as shown in circuit examples of FIGS. 5, 6, or the zener diode is first series connected with at least one diode to produce a zener voltage function, then parallel connected across the two ends of the first light emitting diode (LED101) or of the second light emitting diode (LED102);

FIG. 5 is a circuit example schematic diagram illustrating that the bi-directional conducting light emitting diode set in the circuit of FIG. 2 is further installed with a zener diode.

Figure 7:
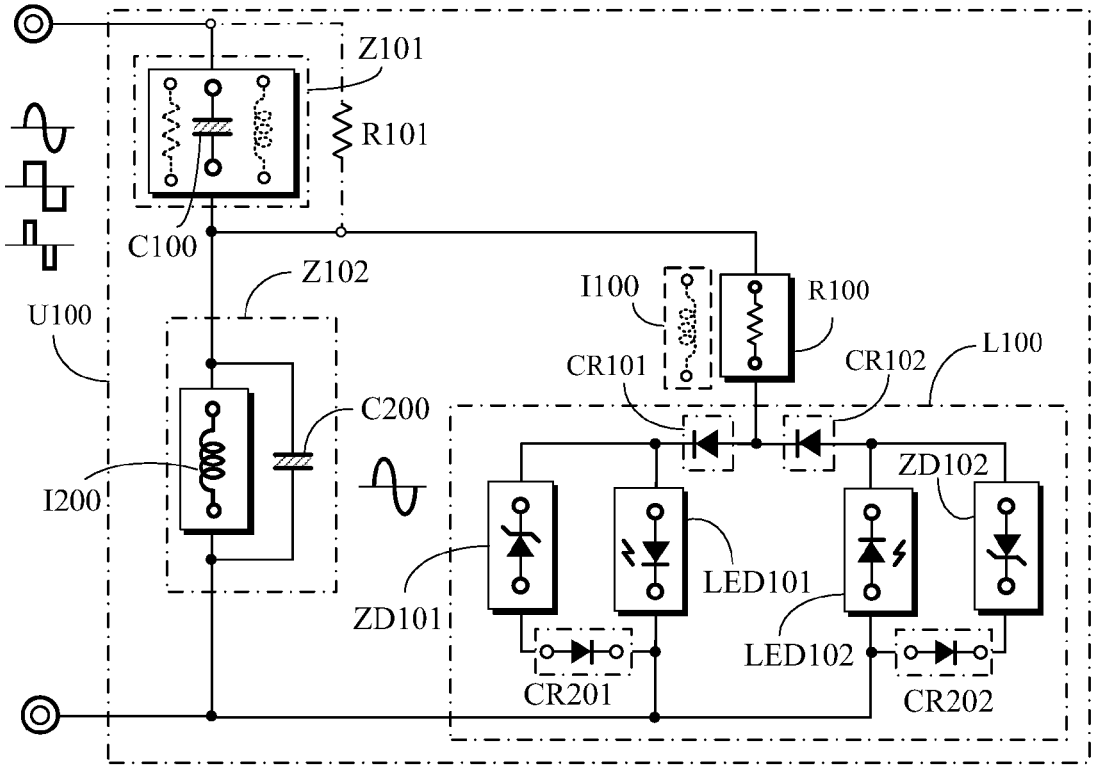
FIG. 7 is a circuit example schematic diagram illustrating that the bi-directional conducting light emitting diode set in the circuit of FIG. 4 is further installed with a zener diode.

FIG. 6 is a circuit example schematic diagram illustrating that the bi-directional conducting light emitting diode set in the circuit of FIG. 3 is further installed with a zener diode;

FIG. 7 is a circuit example schematic diagram illustrating that the bi-directional conducting light emitting diode set in the circuit of FIG. 4 is further installed with a zener diode;

As shown in FIGS. 5, 6 and 7, whereof it is constituted by the following:

1. A zener diode (ZD101) is parallel connected across the two ends of the first light emitting diode (LED101) of the bi-directional conducting light emitting diode set (L100), whereof its polarity relationship is that the zener voltage of the zener diode (ZD101) is used to limit the working voltage across the two ends of the first light emitting diode (LED101);

The said zener diode (ZD101) can be optionally series connected with a diode (CR201) as needed, whereof the advantages are 1) the zener diode (ZD101) can be protected from reverse current; 2) both diode (CR201) and zener diode (ZD101) have temperature compensation effects.

2. If the second light emitting diode (LED102) is selected to consitute the bi-directional conducting light emitting diode set (L100), a zener diode (ZD102) can be selected to parallel connect across the two ends of the second light emitting diode (LED102), whereof their polarity relationship is that the zener voltage of the zener diode (ZD102) is used to limit the working voltage across the two ends of the second light emitting diode (LED102);

The said zener diode (ZD102) can be optionally series connected with a diode (CR202) as needed, whereof the advantages are 1) the zener diode (ZD102) can be protected from reverse current; 2) both diode (CR202) and zener diode (ZD102) have temperature compensation effects.

If the bi-directional conducting light emitting diode set (L100) in the bi-directional light emitting diode drive circuit (U100) of the bi-directional light emitting diode drive circuit in bi-directional power parallel resonance of the present invention is selected to be constituted by the first light emitting diode (LED101) and the second light emitting diode (LED102) in parallel connection of opposite polarities, its constitutions include the following:

A zener diode (ZD101) can be optionally parallel connected as needed across the two ends of the first light emitting diode (LED101) or a zener diode (ZD102) can be optionally parallel connected as needed across the two ends of the second light emitting diode (LED102), whereof their polarity relationships are that the zener voltage of the zener diode (ZD101) is used to limit the working voltage across the two ends of the first light emitting diode (LED101), and the zener voltage of the zener diode (ZD102) is used to limit the working voltage across the two ends of the second light emitting diode (LED102);

The above said zener diode is constituted by the following:

(1) A zener diode (ZD101) is parallel connected across the two ends of the first light emitting diode (LED101) of the bi-directional conducting light emitting diode set (L100), and a zener diode (ZD102) is parallel connected across the two ends of the second light emitting diode (LED102); or (2) The two zener diodes (ZD101) and (ZD102) are reversely series connected and are further parallel connected across the two ends of the bi-directional conducting light emitting diode set (L100); or (3) it can be replaced by parallel connecting a diode with bi-directional zener effect in the circuit of bi-directional conducting light emitting diode set (L100);

All the above said three circuits can avoid over high end voltage of the first light emitting diode (LED101) and the second light emitting diode (LED102); or If the bi-directional conducting light emitting diode set (L100) in the bi-directional light emitting diode drive circuit (U100) of the bi-directional light emitting diode drive circuit in bi-directional power parallel resonance is selected to be constituted by the first light emitting diode (LED101) and the second light emitting diode (LED102) in reversely parallel connection, the constitutions include the following:

The said zener diodes (ZD101) and (ZD102) can be optionally constituted as needed by that a diode (CR201) and a zener diode (ZD101) are in series connection of forward polarities, and a diode (CR202) and a zener diode (ZD102) are in series connection of forward polarities, whereof their advantages are 1) the zener diodes (ZD101) and (ZD102) can be protected from reverse current; 2) both diode (CR201) and zener diode (ZD101) as well as both diode (CR202) and zener diode (ZD102) have temperature compensation effect.

Figure 8:
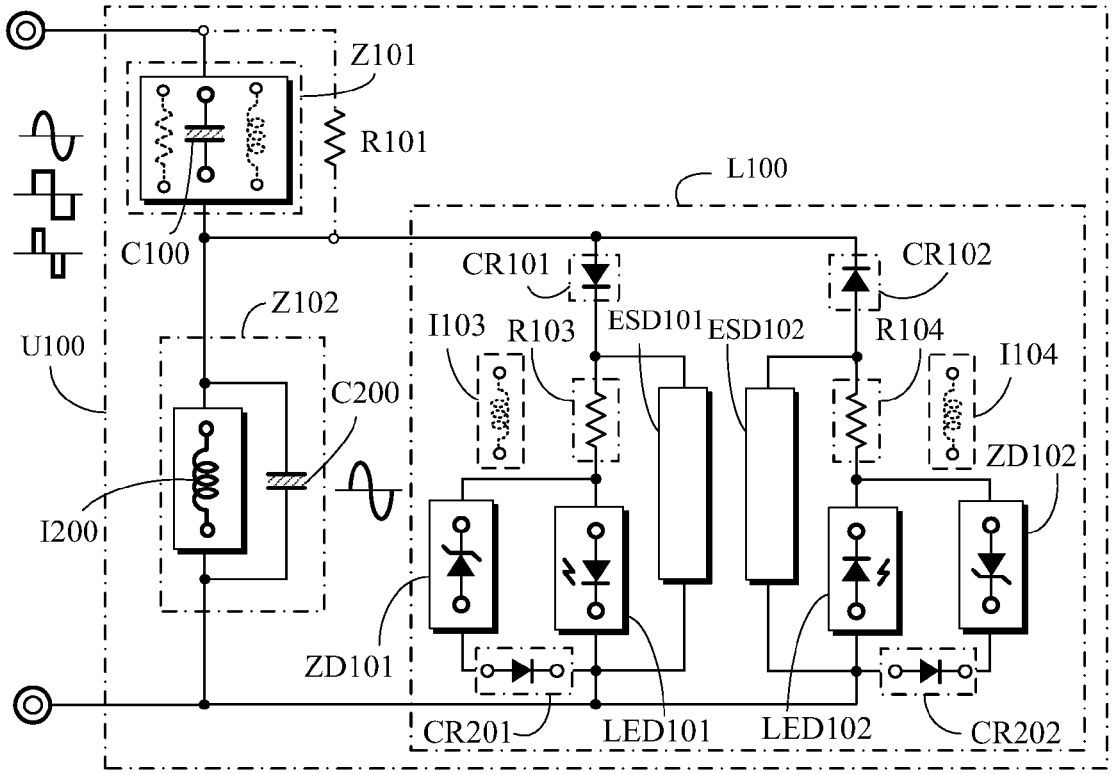
FIG. 8 is a circuit example schematic diagram illustrating that the charge/discharge device is parallel connected across the two ends of a light emitting diode and a current limit resistor in series connection in the circuit of FIG. 5.
Figure 9:
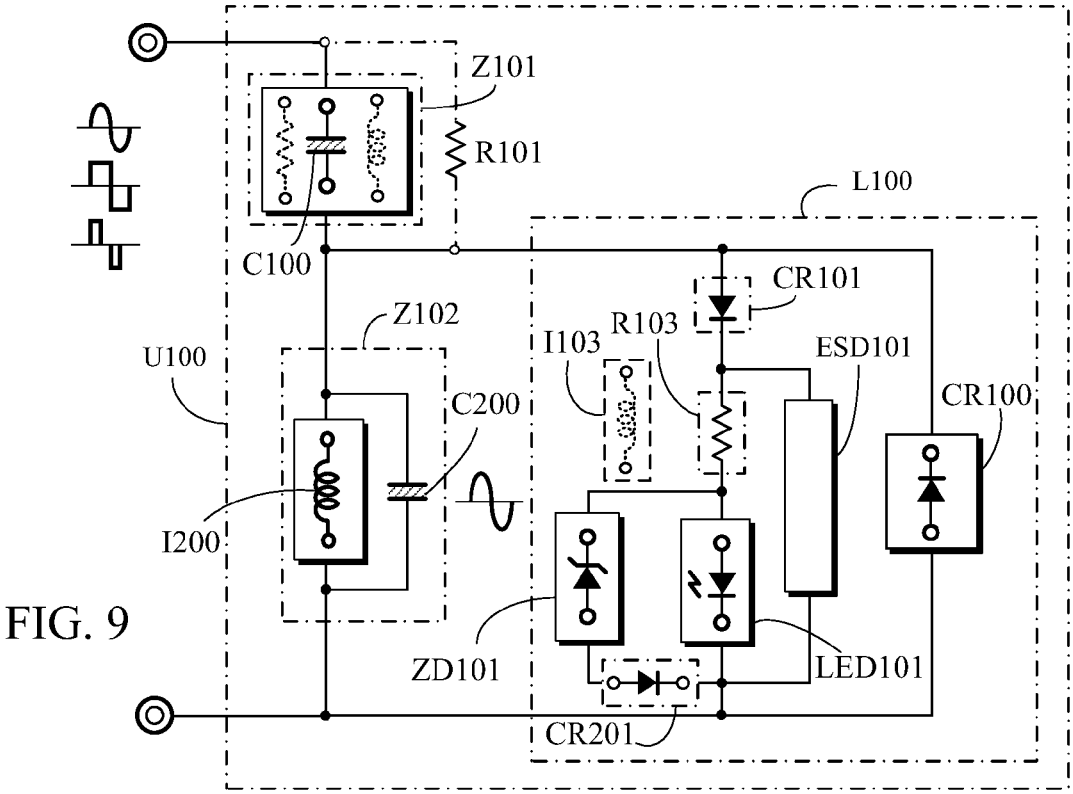
FIG. 9 is a circuit example schematic diagram illustrating that the charge/discharge device is parallel connected across the two ends of a light emitting diode and a current limit resistor in series connection in the circuit of FIG. 6.
Figure 10:
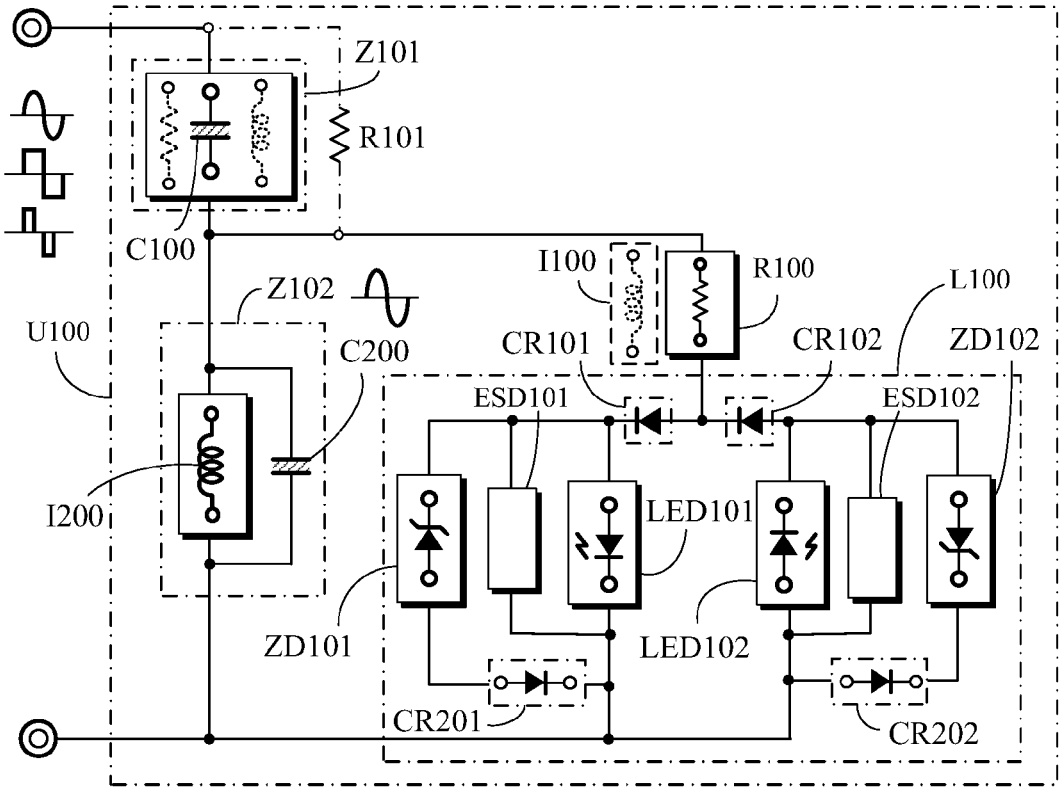
FIG. 10 is a circuit example schematic diagram illustrating that a charge/discharge device is parallel connected across the two ends of the light emitting diode and the current limit resistor in series connection in circuit of FIG. 7.

The bi-directional light emitting diode drive circuit (U100) of the bi-directional light emitting diode drive circuit in bi-directional power parallel resonance as shown in the circuit examples of FIGS. 8, 9 and 10, whereof to promote the lighting stability of the light source produced by the light emitting diode, the first light emitting diode (LED101) can be installed with a charge/discharge device (ESD101), or the second light emitting diode (LED102) can be installed with a charge/discharge device (ESD102), whereof the charge/discharge device (ESD101) and the charge/discharge device (ESD102) have the random charging or discharging characteristics which can stabilize the lighting stability of the first light emitting diode (LED101) and the second light emitting diode (LED102), whereby to reduce their lighting pulsations. The aforesaid charge/discharge devices (ESD101), (ESD102) can be constituted by the conventional charging and discharging batteries, or super-capacitors or capacitors, etc;

The bi-directional light emitting diode drive circuit in bi-directional power parallel resonance can be further optionally installed with a charge/discharge device as needed, whereof it includes:

1. The bi-directional light emitting diode drive circuit in bi-directional power parallel resonance, whereof in its bi-directional light emitting diode drive circuit (U100), a charge/discharge device (ESD101) can be parallel connected across the two ends of the current limit resistor (R103) and the first light emitting diode (LED101) in series connection;

Or a charge/discharge device (ESD102) can be further parallel connected across the two ends of the current limit resistor (R104) and the second light emitting diode (LED102) in series connection;

FIG. 8 is a circuit example schematic diagram illustrating that a charge/discharge device is parallel connected across the two ends of the first light emitting diode, the second light emitting diode and current limit resistor in series connection in the circuit of FIG. 5, whereof it is comprised of:

A charge/discharge device (ESD101) based on its polarity is parallel connected across the two ends of the first light emitting diode (LED101) and the current limit resistor (R103) in series connection, or is directly parallel connected across the two ends of the first light emitting diode (LED101), whereof the charge/discharge device (ESD101) has the random charge/discharge characteristics to stabilize the lighting operation and to reduce the lighting pulsation of the first light emitting diode (LED101);

If the second light emitting diode (LED102) is selected to use, a charge/discharge device (ESD102) based on its polarity is parallel connected across the two ends of the second light emitting diode (LED102) and the current limit resistor (R104) in series connection, whereof the charge/discharge device (ESD102) has the random charge/discharge characteristics to stabilize the lighting operation and to reduce the lighting pulsation of the second light emitting diode (LED102);

The aforesaid charge/discharge devices (ESD101), (ESD102) can be constituted by the conventional charging and discharging batteries, or super-capacitors or capacitors, etc.

2. The bi-directional light emitting diode drive circuit in bi-directional power parallel resonance, whereof if a first light emitting diode LED101) is selected and is reversely parallel connected with a diode (CR100) in the bi-directional light emitting diode drive circuit (U100), then its main circuit structure is as shown in FIG. 9 which is a circuit example schematic diagram illustrating that a charge/discharge device is parallel connected across the two ends of the bi-directional conducting light emitting diode set and the current limit resistor in series connection in the circuit of FIG. 6, whereof a charge/discharge device (ESD101) based on its polarity is parallel connected across the two ends of the first light emitting diode (LED101) and the current limit resistor (R103) in series connection, whereof the charge/discharge device (ESD101) has the random charge/discharge characteristics to stabilize the lighting operation and to reduce the lighting pulsation of the first light emitting diode (LED101);

The aforesaid charge/discharge devices (ESD101), (ESD102) can be constituted by the conventional charging and discharging batteries, or super-capacitors or capacitors, etc.

3. In the bi-directional light emitting diode drive circuit (U100) of the bi-directional light emitting diode drive circuit in bi-directional power parallel resonance, when the current limit resistor (R100) is selected to replace the current limit resistors (R103), (R104) to serve as the common current limit resistor of the bi-directional conducting light emitting diode set (L100) in the bi-directional light emitting diode drive circuit (U100), or the current limit resistors (R103), (R104) and (R100) are not installed, the main circuit structure is as shown in FIG. 10 which is a circuit example schematic diagram illustrating that a charge/discharge device is parallel connected across the two ends of the light emitting diode set and the current limit resistor in series connection in the circuit of FIG. 7, whereof it is comprised of that:

A charge/discharge device (ESD101) is directly parallel connected across the two ends of the first light emitting diode (LED101) of the same polarity, and a charge/discharge device (ESD102) is directly parallel connected across the two ends of the first light emitting diode (LED102) of the same polarity, whereof the charge/discharge devices (ESD101) and (ESD102) has the random charge or discharge characteristics;

The aforesaid charge/discharge devices (ESD101), (ESD102) can be constituted by the conventional charging and discharging batteries, or super-capacitors or capacitors, etc.

4. If the charge/discharge devices (ESD101) or (ESD102) used is uni-polar in the above said items 1, 2, 3, after the first light emitting diode (LED101) is parallel connected with the uni-polar charge/discharge device (ESD101), a diode (CR101) of forward polarity series connection can be optionally installed as needed to prevent reverse voltage from damaging the uni-polar charge/discharge device; whereof after the second light emitting diode (LED102) is parallel connected with the uni-polar charge/discharge device (ESD102), a diode (CR102) of forward polarity series connection can be optionally installed as needed to prevent reverse voltage from damaging the uni-polar charge/discharge device;

5. The two ends of the bi-directional conducting light emitting diode set (L100) can be optionally parallel connected with a bipolar charge/discharge device as needed.

In addition, a charge/discharge device can be further installed across the two ends of the bi-directional conducting light emitting diode set (L100) in the bi-directional light emitting diode drive circuit (U100) for random charging/discharging, thereby besides of stabilizing the lighting stabilities of the first light emitting diode (LED101) and the second light emitting diode (LED102) of the bi-directional conducting light emitting diode set (L100), the charge/discharge device can provide its saving power during a power off to drive at least one of the first light emitting diode (LED101) or the second light emitting diode (LED102) to continue emitting light;

The aforesaid charge/discharge devices (ESD101), (ESD102) can be constituted by the conventional charging and discharging batteries, or super-capacitors or capacitors, etc.

Figure 11:
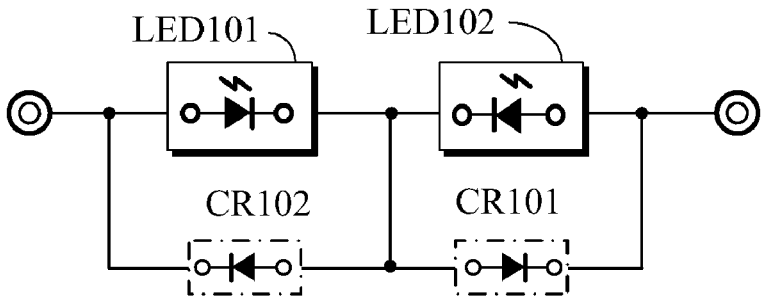
FIG. 11 is a circuit example schematic diagram of the bi-directional conducting light emitting diode set of the present invention illustrating that the first light emitting diode is reversely parallel connected with a diode, and the second light emitting diode is reversely parallel connected with a diode, whereby the two appear in series connection of opposite directions.

The aforesaid bi-directional conducting light emitting diode set (L100), in which the lighting functions of the said bi-directional light emitting diodes are constituted by the following:

(1) It is constituted by at least one first light emitting diode (LED101) and at least one second light emitting diode (LED102) in parallel connection of opposite polarities;

(2) At least one first light emitting diode (LED101) is series connected with a diode (CR101) in forward polarity, and at least one second light emitting diode (LED102) is series connected with a diode (CR102) in forward polarity, thereby the two are further reversely parallel connected;

(3) A diode (CR101) is parallel connected with at least one first light emitting diode (LED101) in opposite polarities, and a diode (CR102) is parallel connected with at least one second light emitting diode (LED102) in opposite polarities, whereof the two are further reversely series connected to constitute a bi-directional conducting light emitting diode set, whereof it is as shown in FIG. 11 which is a circuit example schematic diagram of the bi-directional conducting light emitting diode set of the present invention illustrating that the first light emitting diode is parallel connected with a diode in opposite polarities, and the second light emitting diode is parallel connected with a diode in opposite polarities, whereby the two appear in reversely series connection.

(4) Or it can be constituted by conventional circuit combinations or components which allows the light emitting diode to receive power and to emit light bi-directionally.

Figure 12:
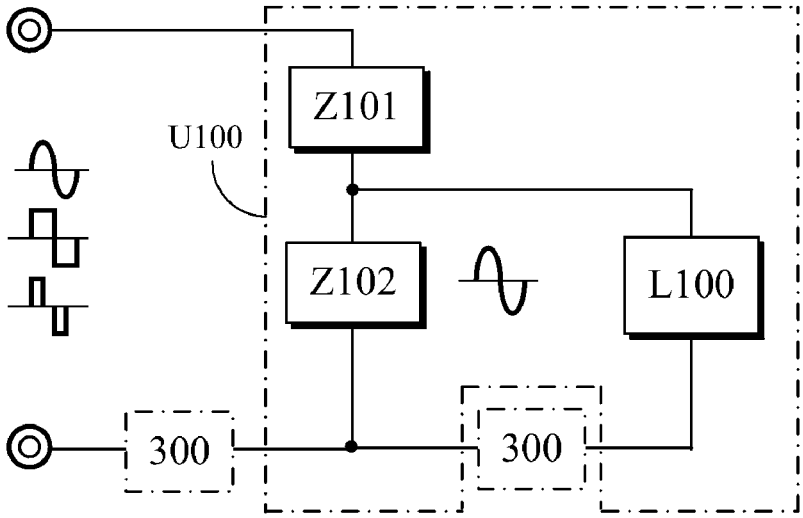
FIG. 12 is a circuit example schematic block diagram of the present invention which is series connected to the bi-directional power modulator of series connection type.
Figure 13:
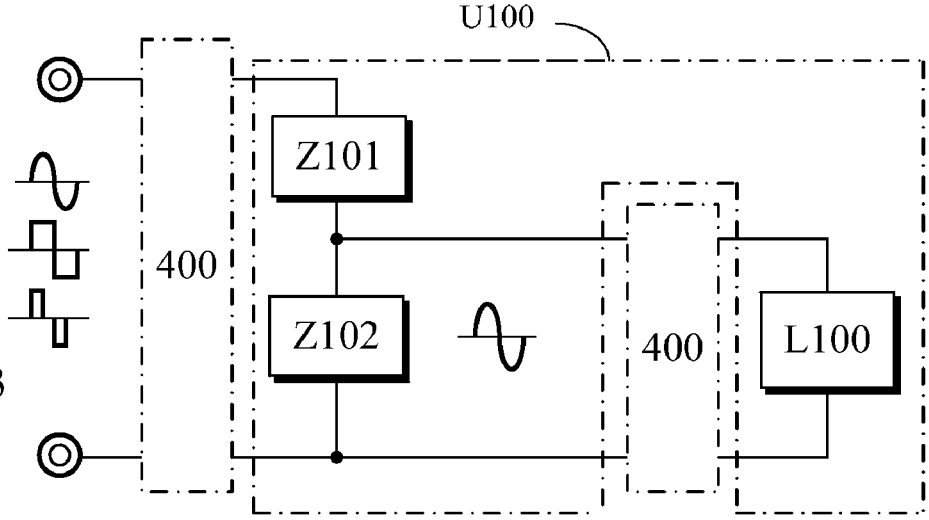
FIG. 13 is a circuit example schematic block diagram of the present invention which is parallel connected to the bi-directional power modulator of parallel connection type.
Figure 14:
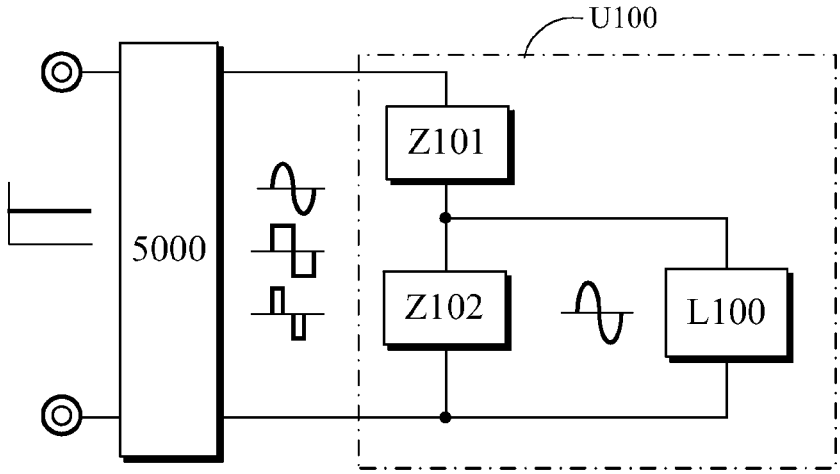
FIG. 14 is a circuit example schematic block diagram of the present invention driven by the DC to AC converter output power.

The first impedance (Z101), the second impedance (Z102) and the bi-directional conducting light emitting diode set (L100) as well as the first light emitting diode (LED101), the second light emitting diode (LED102) and various aforesaid optional auxiliary circuit components as shown in the circuit examples of FIGS. 1~11 are based on application needs, whereof they can be optionally installed or not installed as needed and the installation quantity include constitution by one, wherein if more than one are selected, the corresponding polarity relationship shall be determined based on circuit function requirement to execute series connection, or parallel connection or series and parallel connections; thereof it is constituted as the following:

1. The first impedance (Z101) can be constituted by one, or by more than ones in series connection or parallel connection or series and parallel connection, whereof in multiple installations, each first impedance can be constituted by the same kind of capacitors (C100), inductive impedance components, or resistive impedance components, or other different kinds of impedance components, in which their impedance values can be the same or different;

2. The second impedance (Z102) can be constituted by the capacitor (C200) and the inductive impedance component (I200) in parallel connection to have the same frequency with the bi-directional power from power source such as the frequency of an AC power, or the alternated polarity period of the constant or variable voltage and the constant or variable periodically alternated polarity power converted from a DC power to appear in a parallel resonance status. The second impedance can be constituted by one or more than one in series connection or parallel connection or series and parallel connection, whereof in multiple installations, each second impedance can be constituted by the same kind of capacitive and inductive impedance components in parallel connection to have the same frequency of the bi-directional power source such as the frequency of an AC power, or the alternated polarity period of the constant or variable voltage and the constant or variable periodically alternated polarity power converted from a DC power to appear in a parallel resonance status, whereof their impedance values can be the same or different, but the parallel resonance periods are the same;

3. The first light emitting diode (LED101) can be constituted by one light emitting diode, or by more than one light emitting diodes in series connection of forward polarities, or in parallel connection of the same polarity or in series and parallel connection;

4. The second light emitting diode (LED102) can be constituted by one light emitting diode, or by more than one light emitting diodes in series connection of forward polarities, or in parallel connection of the same polarity or in series and parallel connection;

5. In the bi-directional light emitting diode drive circuit (U100):

(1) It can be optionally installed with one bi-directional conducting light emitting diode set (L100), or more than one set of the bi-directional conducting light emitting diode sets (L100) in series connection, parallel connection or in series and parallel connection, whereof if one set or more than one sets are selected to be installed, they can be driven together by the divided power at a common second impedance (Z102) or driven individually by the corresponding divided power at each of the multiple second impedances (Z102) which are in series connection or parallel connection;

(2) If a charge/discharge device (ESD101) or (ESD102) is installed in the bi-directional light emitting diode drive circuit (U100), the light emitting diode (LED101) or (LED102) of the bi-directional conducting light emitting diode set (L100) is driven by DC power to emit light continuously;

If the charge/discharge device (ESD101) or (ESD102) is not installed, then current conduction to light emitting diode (LED101) or (LED102) is intermittent, whereby referring to the input voltage wave shape and duty cycle of current conduction, the light emitting forward current and the peak of light emitting forward voltage of each light emitting diode in the bi-directional conducting light emitting diode set (L100) can be correspondingly selected for the light emitting diodes (LED101) or (LED102), whereof the selections include the following:

1) The light emitting peak of forward voltage is lower than the rated forward voltage of light emitting diode (LED101) or (LED102); or 2) The rated forward voltage of light emitting diode (LED101) or (LED102) is selected to be the light emitting peak of forward voltage; or 3) If current conduction to light emitting diode (LED101) or (LED102) is intermittent, the peak of light emitting forward voltage can be correspondingly selected based on the duty cycle of current conduction as long as the principle of that the peak of light emitting forward voltage does not damage the light emitting diode (LED101) or (LED102) is followed;

Based on the value and wave shape of the aforesaid light emitting forward voltage, the corresponding current value and wave shape from the forward voltage vs. forward current ratio are produced; however the peak of light emitting forward current shall follow the principle not to damage the light emitting diode (LED101) or (LED102);

The luminosity or the stepped or step-less luminosity modulation of the forward current vs. relative luminosity can be controlled based on the aforesaid value and wave shape of forward current;

6. The diode (CR100), (CR101), (CR102), (CR201) and (CR202) can be constituted by one diode, or by more than one diodes in series connection of forward polarity, or in parallel connection of the same polarity, or in series and parallel connection, whereof said devices can be optionally installed as needed;

7. The discharge resistor (R101) and current limit resistors (R100), (R103), (R104) can be constituted by one resistor, or by more than one resistors in series connection or parallel connection or series and parallel connection, whereof said devices can be optionally installed as needed;

8. The inductive impedance components (I100), (I103), (I104) can be constituted by one impedance component, or by more than one impedance components in series connection or parallel connection or series and parallel connection, whereof said devices can be optionally installed as needed;

9. The zener diodes (ZD101), (ZD102) can be constituted by one zener diode, or by more than one zener diodes in series connection of forward polarity, or in parallel connection of the same polarity, or in series and parallel connection, whereof said devices can be optionally installed as needed;

10. The charge/discharge devices (ESD101), (ESD102) can be constituted by one, or by more than ones in series connection of forward polarity, or in parallel connection of the same polarity, or in series and parallel connection, whereof said devices can be optionally installed as needed;

In the application of the bi-directional light emitting diode drive circuit (U100) of the bi-directional light emitting diode drive circuit in bi-directional power parallel resonance of the present invention, the following different types of bi-directional AC power can be provided for inputs, whereof the bi-directional power includes that:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (1) The AC power of bi-directional sinusoidal wave voltage or bi-directional square wave voltage, or bi-directional pulse wave voltage with constant or variable voltage and constant or variable frequency or period converted from the DC power which is further rectified from an AC power;

The bi-directional light emitting diode drive circuit in bi-directional power of parallel resonance can be further optionally combined with the following active modulating circuit devices as needed, whereof the applied circuits are the following:

1. FIG. 12 is a circuit example schematic block diagram of the present invention which is series connected to the bi-directional power modulator of series connection type, whereof the bi-directional power modulator of series connection type is constituted by the following:

A bi-directional power modulator of series connection type (300): It is constituted by the conventional electromechanical components or solid state power components and related electronic circuit components to modulate the bi-directional power output;

The circuit operating functions are the following:

(1) The bi-directional power modulator of series connection type (300) can be optionally installed as needed to be series connected with the bi-directional light emitting diode drive circuit (U100) to receive the bi-directional power from power source, whereby the bi-directional power is modulated by the bi-directional power modulator of series connection type (300) to execute power modulations such as pulse width modulation or current conduction phase angle control, or impedance modulation, etc. to drive the bi-directional light emitting diode drive circuit (U100); or (2) The bi-directional power modulator of series connection type (300) can be optionally installed as needed to be series connected between the second impedance (Z102) and the bi-directional conducting light emitting diode set (L100) whereby the bi-directional divided power in parallel resonance across the two ends of the second impedance (Z102) is modulated by the bi-directional power modulator of series connection type (300) to execute power modulations such as pulse width modulation or current conduction phase angle control, or impedance modulation, etc. to drive the bi-directional conducting light emitting diode set (L100);

2. FIG. 13 is a circuit example schematic block diagram of the present invention which is parallel connected to a bi-directional power modulator of parallel connection type, whereof the bi-directional power modulator of parallel connection type is constituted by the following:

A bi-directional power modulator of parallel connection type (400): It is constituted by the conventional electromechanical components or solid state power components and related electronic circuit components to modulate the bi-directional power output;

The circuit operating functions are the following:

(1) The bi-directional power modulator of parallel connection type (400) can be optionally installed as needed, whereof its output ends are for parallel connection with the bi-directional light emitting diode drive circuit (U100), while its input ends are provided for receiving the bi-directional power from the power source, whereby the bi-directional power is modulated by the bi-directional power modulator of parallel connection type (400) to execute power modulations such as pulse width modulation or current conduction phase angle control, or impedance modulation, etc. to drive the bi-directional light emitting diode drive circuit (U100); or (2) The bi-directional power modulator of parallel connection type (400) can be optionally installed as needed, whereof its output ends are parallel connected with the input ends of the bi-directional conducting light emitting diode set (L100) while its input ends are parallel connected with the second impedance (Z102), whereby the bi-direction divided power in parallel resonance across the two ends of the second impedance (Z102) is modulated by the bi-directional power modulator of parallel connection type (400) to execute power modulations such as pulse width modulation or current conduction phase angle control, or impedance modulation, etc. to drive the bi-directional conducting light emitting diode set (L100);

3. FIG. 14 is a circuit example schematic block diagram of the present invention driven by a DC to AC inverter output power;

It is mainly comprised of that:

A DC to AC Inverter (4000): it is constituted by the conventional electromechanical components or solid state power components and related electronic circuit components, whereof its input ends are optionally provided as needed to receive input from a constant or variable voltage DC power, or a DC power rectified from an AC power, while its output ends are optionally selected as needed to supply bi-directional AC power of bi-directional sinusoidal wave, or bi-directional square wave or bi-directional pulse wave in a constant or variable voltage and constant or variable alternated polarity frequency or periods to be used as the power source to supply bi-directional power;

The circuit operating functions are the following:

The bi-directional light emitting diode drive circuit (U100) is parallel connected across the output ends of the conventional DC to AC inverter (4000); the input ends of the DC to AC inverter (4000) are optionally provided as needed to receive input from a constant or variable voltage DC power, or a DC power rectified from an AC power;

The output ends of the DC to AC inverter (4000) can be optionally selected as needed to provide power of bi-directional sinusoidal wave, or bi-directional square wave, or bi-directional pulse wave in a constant or variable voltage and constant or variable alternated period, whereof it can be further supplied to the two ends of the first impedance (Z101) and the second impedance (Z102) of the bi-directional light emitting diode drive circuit (U100) in series connection, whereof the divided power across the two ends of the second impedance (Z102) is then used to transmit to the bi-directional conducting light emitting diode set (L100);

In addition, the bi-directional light emitting diode drive circuit (U100) can be controlled and driven by means of modulating the output power from the DC to AC inverter (4000), as well as by executing power modulations to the power outputted such as pulse width modulation, or conductive current phase angle control, or impedance modulation, etc.;

4. The bi-directional light emitting diode drive circuit (U100) which is arranged to be series connected with at least one conventional impedance component (500) and further to be parallel connected with the power source, whereof the impedance (500) includes that:

(1) An impedance component (500): it is constituted by a component with resistive impedance characteristics; or (2) An impedance component (500): it is constituted by a component with inductive impedance characteristics; or (3) An impedance component (500): it is constituted by a component with capacitive impedance characteristics; or (4) An impedance component (500): it is constituted by a single impedance component with the combined impedance characteristics of at least two of the resistive impedance, or inductive impedance, or capacitive impedance simultaneously, thereby to provide DC or AC impedances; or (5) An impedance component (500): it is constituted by a single impedance component with the combined impedance characteristics of inductive impedance and capacitive impedance, whereof its inherent parallel resonance frequency is the same as the frequency or period of bi-directional power from power source, thereby to produce a parallel resonance status; or (6) An impedance component (500): it is constituted by one kind or more than one kind of one or more than ones capacitive impedance component, or inductive impedance component, or resistive impedance component or by two kinds or more than two kinds of impedance components in series connection, or parallel connection, or series and parallel connection so as to provide DC or AC impedances; or (7) An impedance component (500): it is constituted by the mutual series connection of a capacitive impedance component and an inductive impedance component, whereof its inherent series resonance frequency is the same as the frequency or period of bi-directional power from power source to produce a series resonance status and the end voltage across two ends of the capacitive impedance component or the inductive impedance component appear in series resonance correspondingly;

Or the capacitive impedance and the inductive impedance are in mutual parallel connection, whereby its inherent parallel resonance frequency is the same as the frequency or period of bi-directional power from power source, thereby to produce a parallel resonance status and appear the corresponding end voltage.

Figure 15:
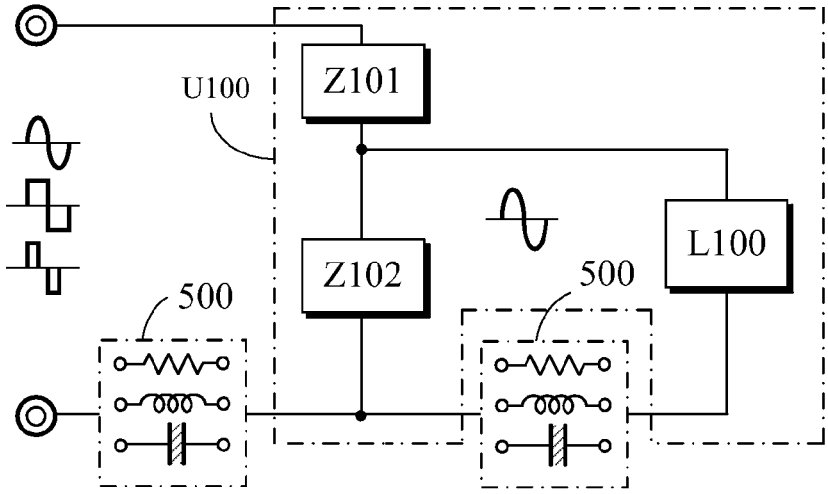
FIG. 15 is a circuit example schematic block diagram of the present invention which is series connected with impedance components.
Figure 16:
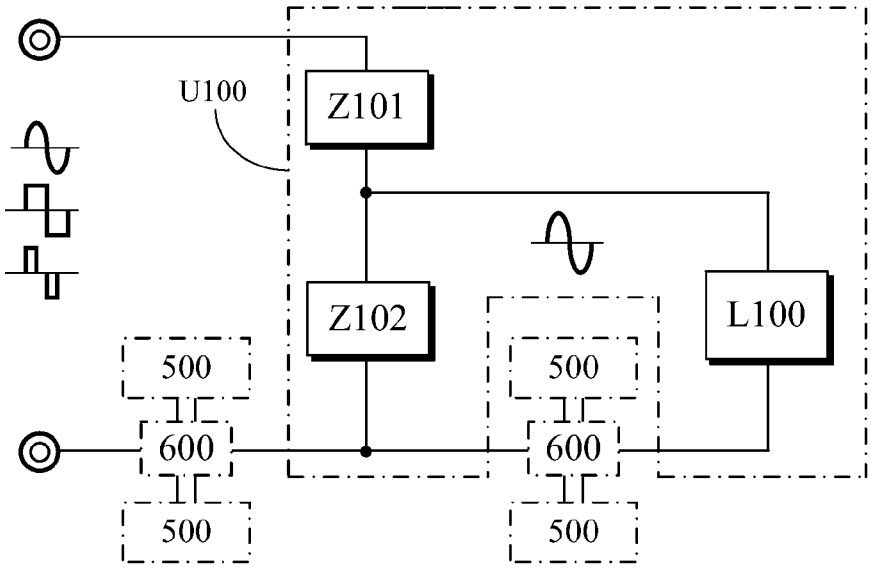
FIG. 16 is a circuit example schematic block diagram of the present invention illustrating that the impedance components in series connection execute series connection, or parallel connection, or series and parallel connection by means of the switching device.

FIG. 15 is a circuit example schematic block diagram of the present invention which is series connected with impedance components;

5. At least two impedance components (500) as said in the item 4 execute switches between series connection, parallel connection and series and parallel connection bye means of the switching device (600) which is constituted by electromechanical components or solid state components, whereby to modulate the power transmitted to the bi-directional light emitting diode drive circuit (U100), wherein FIG. 16 is a circuit example schematic block diagram of the present invention illustrating that the impedance components in series connection execute series connection, or parallel connection, or series and parallel connection by means of the switching device.

Figure 17:
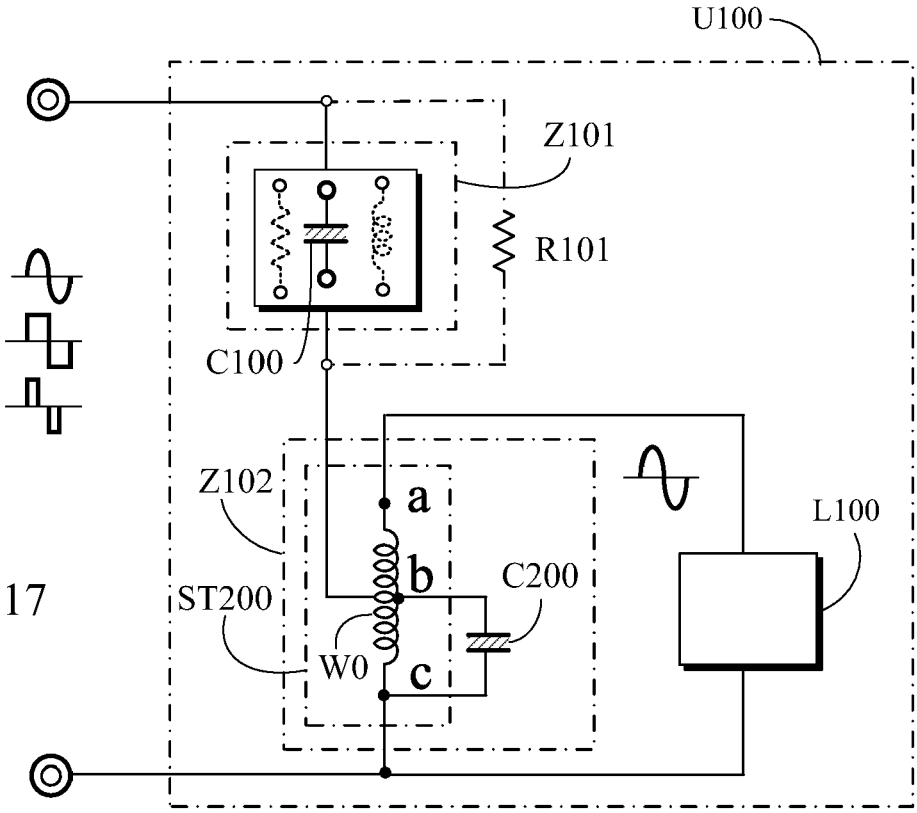
FIG. 17 is a circuit example schematic diagram of the present invention illustrating that the inductive impedance component of the second impedance is replaced by the self-coupled voltage change power supply side winding of the self-coupled transformer thereby to constitute a voltage rise.
Figure 18:
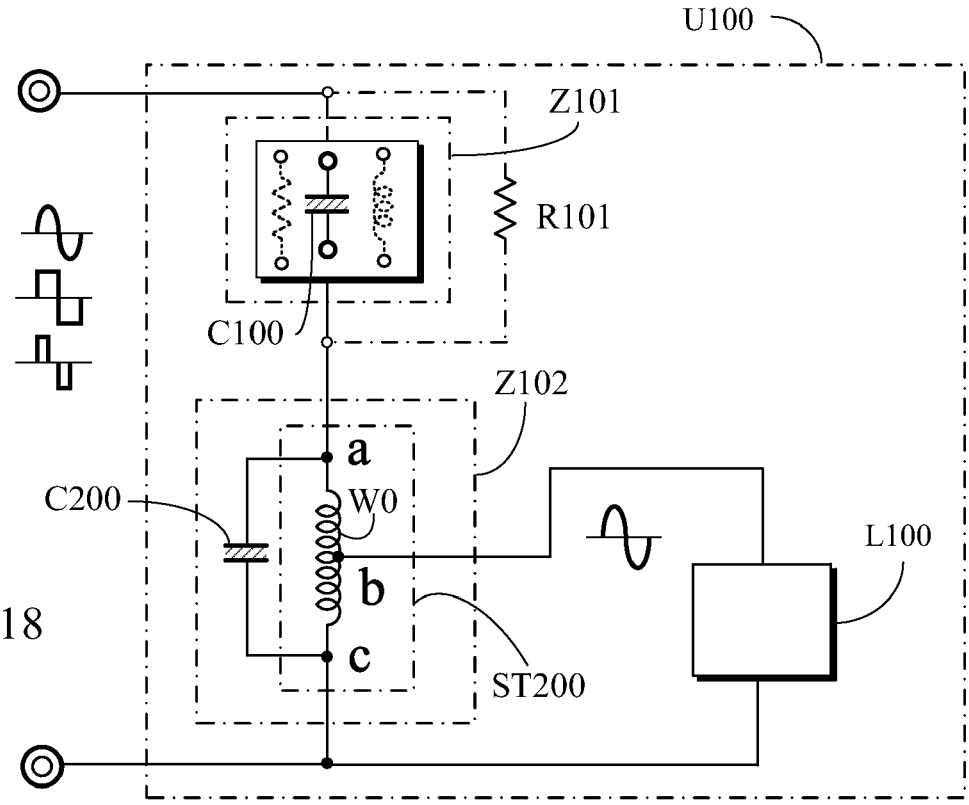
FIG. 18 is a circuit example schematic diagram of the present invention illustrating that the inductive impedance component of the second impedance is replaced by the self-coupled voltage change power supply side winding of the self-coupled transformer thereby to constitute a voltage drop.
Figure 19:
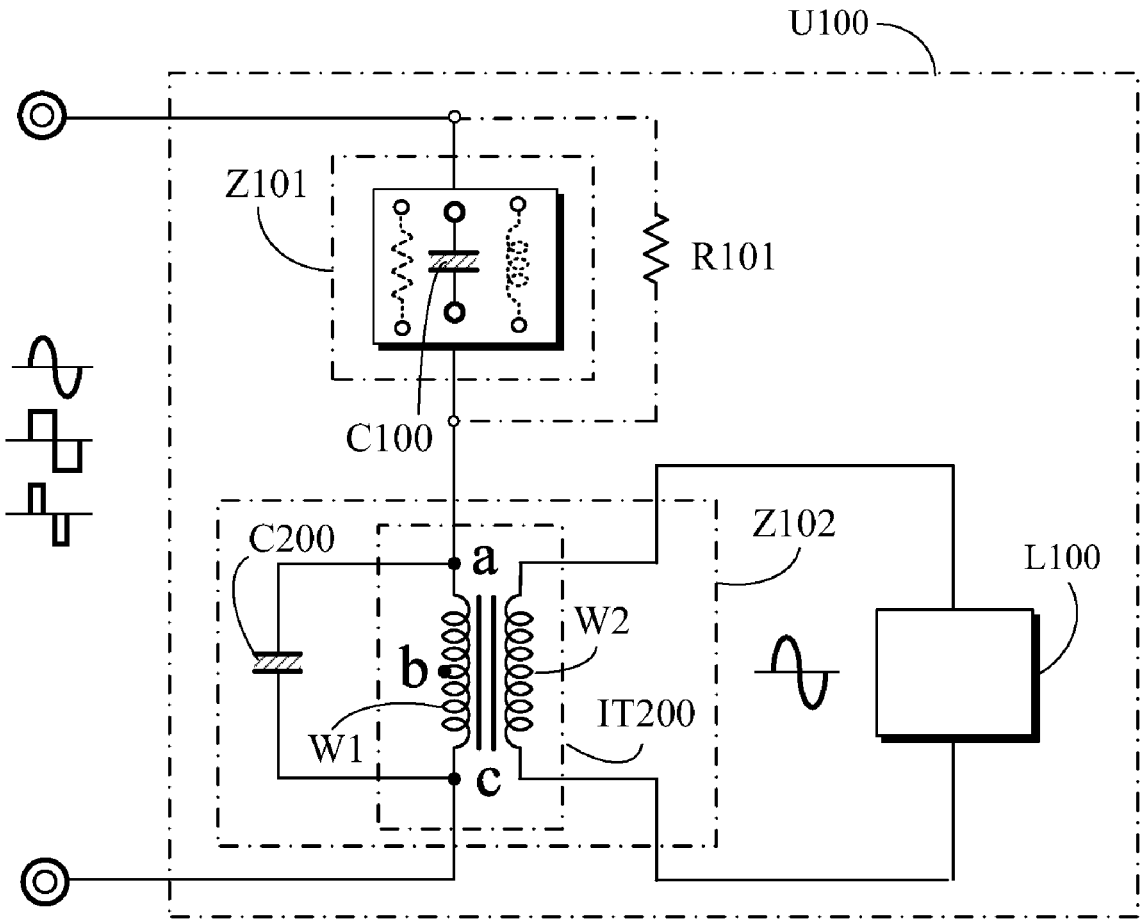
FIG. 19 is a circuit example schematic diagram of the present invention illustrating that the inductive impedance component of the second impedance is replaced by the primary side winding of the separating type transformer with separating type voltage change winding.

The bi-directional light emitting diode drive circuit in bi-directional power parallel resonance, in which the optionally installed inductive impedance component (I200) of the second impedance (Z102) can be further replaced by the power supply side winding of a transformer with inductive effect, whereof the transformer can be a self-coupled transformer (ST200) with self-coupled voltage change winding or a transformer (IT200) with separating type voltage change winding;

FIG. 17 is a circuit example schematic diagram of the present invention illustrating that the inductive impedance component of the second impedance is replaced by the self-coupled voltage change power supply side winding of the self-coupled transformer thereby to constitute a voltage rise, whereof as shown in FIG. 17, the self-coupled transformer (ST200) has a self-coupled voltage change winding (W0) with voltage raising function, the b, c ends of the self-coupled voltage change winding (W0) of the self-coupled transformer (ST200) are the power supply side which replace the inductive impedance component (I200) of the second impedance (Z102) to be parallel connected with the capacitor (C200), whereof its inherent parallel resonance frequency after parallel connection is the same as the frequency of the bi-directional power source such as the frequency of an Ac power, or the alternated polarity period of the constant or variable voltage and the constant or variable periodically alternated polarity power converted from a DC power to appear in a parallel resonance status, thereby to constitute the second impedance (Z102) which is series connected with the capacitor (C100) of the first impedance (Z101), further, the capacitor (C200) can be optionally parallel connected with the a, c taps or b, c taps of the self-coupled transformer (ST200), or other selected taps as needed, whereof the a, c output ends of the self-coupled voltage change winding (W0) of the self-coupled transformer (ST200) are arranged to provide AC power of voltage rise to drive the bi-directional conducting light emitting diode set (L100);

FIG. 18 is a circuit example schematic diagram of the present invention illustrating that the inductive impedance component of the second impedance is replaced by the self-coupled voltage change power supply side winding of the self-coupled transformer thereby to constitute a voltage drop, whereof as shown in FIG. 18, the self-coupled transformer (ST200) has a self-coupled voltage change winding (W0) with voltage drop function, in which the b, c ends of the self-coupled voltage change winding (W0) of the self-coupled transformer (ST200) are the power supply side which replace the inductive impedance component (I200) of the second impedance (Z102) to be parallel connected with the capacitor (C200), whereof its parallel resonance frequency after parallel connection is the same as the frequency of the bi-directional power source such as the frequency of an AC power, or the alternated polarity period of the constant or variable voltage and the constant or variable periodically alternated polarity power converted from a DC power to appear in a parallel resonance status, thereby to constitute the second impedance (Z102), which is series connected with the capacitor (C100) of the first impedance (Z101), further, the capacitor (C200) can be optionally parallel connected with the a, c taps or b, c taps of the self-coupled transformer (ST200), or other selected taps as needed, whereof the a, c output ends of the self-coupled voltage change winding (W0) of the self-coupled transformer (ST200) are arranged to provide AC power of voltage drop to drive the bi-directional conducting light emitting diode set (L100);

FIG. 19 is a circuit example schematic diagram of the present invention illustrating that the inductive impedance component of the second impedance is replaced by the primary side winding of the separating type transformer with separating type voltage change winding, whereof as shown in FIG. 19, the separating type transformer (IT200) is comprised of a primary side winding (W1) and a secondary side winding (W2), in which the primary side winding (W1) and the secondary side winding (W2) are separated, while the primary side winding (W1) is parallel connected with the capacitor (C200), whereof their inherent parallel resonance frequency after parallel connection is the same as the frequency of the bi-directional power source such as the frequency of an AC power, or the alternated polarity period of the constant or variable voltage and the constant or variable periodically alternated polarity power converted from a DC power to appear in a parallel resonance status, thereby to constitute the second impedance (Z102) which is series connected with the capacitor (C100) of the first impedance (Z101), and the capacitor (C200) can be optionally parallel connected with the a, c taps or b, c taps of the self-coupled transformer (ST200), or other selected taps as needed. The output voltage of the secondary side winding (W2) of the separating type transformer (IT200) can be optionally selected as needed to provide AC power of voltage rise or voltage drop to drive the bi-directional conducting light emitting diode set (L100).

Through the above description, the inductive impedance component (I200) of the second impedance (Z102) is replaced by the power supply side winding of the transformer and is parallel connected with the capacitor (C200) to appear parallel resonance, thereby to constitute the second impedance (Z102), while the secondary side of the separating type transformer (IT200) provides AC power of voltage rise or voltage drop to drive the bi-directional conducting light emitting diode set (L100).

Color of the individual light emitting diodes (LED101) of the bi-directional conducting light emitting diode set (L100) in the bi-directional light emitting diode drive circuit (U100) of the bi-directional light emitting diode drive circuit in bi-directional power parallel resonance can be optionally selected to be constituted by one or more than one colors.

The relationships of location arrangement between the individual light emitting diodes (LED101) of the bi-directional conducting light emitting diode set (L100) in the bi-directional light emitting diode drive circuit (U100) of the bi-directional light emitting diode drive circuit in bi-directional power parallel resonance include the following: 1) sequentially linear arrangement; 2) sequentially distributed in a plane; 3) crisscross-linear arrangement; 4) crisscross distribution in a plane; 5) arrangement based on particular geometric positions in a plane; 6) arrangement based on 3D geometric position.

The bi-directional light emitting diode drive circuit in bi-directional power parallel resonance, in which the embodiments of its bi-directional light emitting diode drive circuit (U100) are constituted by circuit components which include: 1) It is constituted by individual circuit components which are inter-connected; 2) At least two circuit components are combined to at least two partial functioning units which are further inter-connected; 3) All components are integrated together to one structure.

As is summarized from above descriptions, progressive performances of power saving, low heat loss and low cost can be provided by the bi-directional light emitting diode drive circuit in bi-directional power parallel resonance through the charging/discharging by the uni-polar capacitor to drive the light emitting diode.

The invention claimed is:

1. A bi-directional light emitting diode drive circuit in bi-directional power parallel resonance, in which the bi-directional light emitting diode drive circuit (U100) includes at least one capacitive impedance component, or inductive impedance component or resistive impedance component to constitute at least one first impedance;

at least one capacitive impedance component and at least one inductive impedance component are in parallel connection to constitute a second impedance, wherein the inherent parallel resonance frequency of the second impedance is the same as the frequency or period of the bi-directional power, thereby to produce a parallel resonance status;

the first impedance and the second impedance are in mutual series connection to receive the following bi-directional powers which includes the following:

1) the AC power with a constant or variable voltage and a constant or variable frequency; or 2) the AC power of bi-directional sinusoidal wave voltage or bi-directional square wave voltage, or bi-directional pulse wave voltage with constant or variable voltage and constant or variable frequency or period which is converted from a DC power source; or 3) the AC power of bi-directional sinusoidal wave voltage or bi-directional square wave voltage, or bi-directional pulse wave voltage with constant or variable voltage and constant or variable frequency or period converted from the DC power which is further rectified from an AC power;

wherein a bi-directional conducting light emitting diode set (L100) which includes at least one first light emitting diode (LED101) and at least one second light emitting diode (LED102) in parallel connection of opposite polarities, wherein the number of the first light emitting diode (LED101) and the second light emitting diode (LED102) can be the same or different, further, the first light emitting diode (LED101) and the second light emitting diode (LED102) is configured to individually include a forward current polarity light emitting diode; or two or more than two forward current polarity light emitting diodes in series or parallel connections; or three or more than three forward current polarity light emitting diodes in series or parallel connections or in series and parallel connections;

the bi-directional conducting light emitting diode set (L100) is configured to be installed with one or more than one sets as needed, wherein it is parallel connected across the two ends of both or either of the first impedance (Z101) or the second impedance (Z102) to form the divided power at the two ends of the first impedance (Z101) and the second impedance (Z102) respectively by the power input, to drive the bi-directional conducting light emitting diode set (L100) to emit light, thus to constitute the bi-directional light emitting diode drive circuit in bi-directional power parallel resonance of the present invention;

wherein:

the first impedance (Z101) includes:

1) the first impedance (Z101) includes at least one capacitor (C100) or at least one inductive impedance component or at least one resistive impedance component, or one kind or more than one kind and one or more than one said impedance components, or by two or more than two kinds of impedance components, wherein the impedance components are respectively one or more than one in series connection or parallel connection, or series and parallel connection, to provide DC or AC impedances; or 2) the first impedance (Z101) includes at least one capacitive impedance component and at least one inductive impedance component in mutual series connection, wherein their inherent series resonance frequency after series connection is the same as the frequency of bi-directional power source such as the frequency of an AC power, or the alternated polarity period of the constant or variable periodically alternated polarity power converted from the DC power, thereby to produce a series resonance status; or 3) the first impedance (Z101) includes at least one capacitive impedance component and at least one inductive impedance component in mutual parallel connection, wherein the inherent parallel resonance frequency after parallel connection is the same as the frequency of bi-directional power source such as the frequency of an AC power, or the alternated polarity period of the constant or variable periodically alternated polarity power converted from the DC power, thereby to produce a low energy consuming alternated polarity power storage status at parallel resonance frequency and to appear a divided end voltage status corresponding to the second impedance;

the second impedance (Z102) includes:

at least one inductive impedance component (I200) and at least one capacitor (C200) in parallel connection, wherein its frequency is the same as the frequency of the bi-directional power source such as the frequency of an AC power, or the alternated polarity period of the constant or variable voltage and the constant or variable periodically alternated polarity power converted from a DC power to appear in a parallel resonance status, thereby to present a divided end voltage status corresponding to the first impedance;

at least one of the three kinds of the capacitive impedance components, inductive impedance components or resistive impedance components is configured to be selected as needed to constitute the first impedance (Z101) in the bi-directional light emitting diode drive circuit in bi-directional power parallel resonance;

the first impedance (Z101) and the second impedance (Z102) are in mutual series connection, wherein the two ends of the first impedance (Z101) and the second impedance (Z102) in mutual series connection are provided to receive the following bi-directional powers:

1) the AC power with a constant or variable voltage and a constant or variable frequency; or 2) the AC power of bi-directional sinusoidal wave voltage or bi-directional square wave voltage, or bi-directional pulse wave voltage with constant or variable voltage and constant or variable frequency or period which is converted from a DC power source; or 3) the AC power of bi-directional sinusoidal wave voltage or bi-directional square wave voltage, or bi-directional pulse wave voltage with constant or variable voltage and constant or variable frequency or period converted from the DC power which is further rectified from an AC power;

a bi-directional conducting light emitting diode set (L100) includes at least one first light emitting diode (LED101) and at least one second light emitting diode (LED102) in parallel connection of opposite polarities, wherein the number of first light emitting diodes (LED101) and the number of second light emitting diodes (LED102) can be the same or different, and the first light emitting diode (LED101) and the second light emitting diode (LED102) are individually constituted by a forward current polarity light emitting diode, or by two or more than two forward current polarity light emitting diodes in series connection or parallel connection, or by three or more than three forward current polarity light emitting diodes in series connection, parallel connection or series and parallel connection;

at least one set of the bi-directional conducting light emitting diode set (L100) is configured to be selected as needed to be parallel connected across the two ends of both or either of the first impedance (Z101) or the second impedance (Z102), wherein the divided power is formed across the two ends of first impedance (Z101) and the two ends of second impedance (Z102) by means of power input, to drive the bi-directional conducting light emitting diode set (L100) which is parallel connected across the two ends of the first impedance (Z101) or the two ends of the second impedance (Z102) to emit light;

the bi-directional light emitting diode drive circuit (U100) in the bi-directional light emitting diode drive circuit in bi-directional power parallel resonance of the present invention, in which the first impedance (Z101) and the second impedance (Z102) as well as the bi-directional conducting light emitting diode set (L100) can be selected to be one or more than one as needed;

the first impedance (Z101), the second impedance (Z102) and the bi-directional conducting light emitting diode set (L100) as well as the first light emitting diode (LED101), the second light emitting diode (LED102) and various optional auxiliary circuit components are based on application needs, wherein they is configured to be installed or not installed as needed and the installation quantity include constitution by one, wherein if more than one are selected, the corresponding polarity relationship shall be determined based on circuit function requirement to execute series connection, or parallel connection or series and parallel connections.

2. A bi-directional light emitting diode drive circuit in bi-directional power parallel resonance as claimed in claim 1, wherein:

the first impedance (Z101) includes at least one capacitor (C100) with especially referring to a bipolar capacitor, wherein the number of the first impedances can be one or more than one;

the second impedance (Z102) includes at least one inductive impedance component (I200) and at least one capacitor (C200) in parallel connection with especially referring to be constituted by an inductive impedance component and a bipolar capacitor, so that its frequency is the same as the frequency of the bi-directional power such as the frequency of an AC power, or the alternated polarity period of the constant or variable voltage and the constant or variable periodically alternated polarity power converted from a DC power to appear in a parallel resonance status; further, the number of the second impedances can be one or more than one;

the first impedance (Z101) and the second impedance (Z102) are in series connection while the two ends of the said series connection is provided with a bi-directional power input, thereby to form a divided power in parallel resonance at the second impedance (Z102), and at least one bi-directional conducting light emitting diode set (L100) is driven by the said divided power;

the bi-directional conducting light emitting diode set (L100) includes at least one first light emitting diode (LED101) and at least one second light emitting diode (LED102) in parallel connection of opposite polarities, wherein the number of the first light emitting diode (LED101) and the number of the second light emitting diode (LED102) can be the same or different, further, the first light emitting diode (LED101) and the second light emitting diode (LED102) can be individually constituted by a forward current polarity light emitting diode; or two or more than two forward current polarity light emitting diodes in series or parallel connections; or three or more than three forward current polarity light emitting diodes in series or parallel connections or in series and parallel connections; the bi-directional conducting light emitting diode set (L100) is configured to be installed with one or more than one sets as needed, wherein it is parallel connected across the two ends of both or either the first impedance (Z101) or the second impedance (Z102) to form the divided power which is used to drive the bi-directional conducting light emitting diode set (L100) to emit light; or the bi-directional conducting light emitting diode set (L100) is parallel connected across the two ends of at least one second impedance (Z102), to be driven by the divided power across the two ends of the second impedance (Z102) which is in parallel resonance with the bi-directional power period, while the impedance of the first impedance (Z101) is used to limit its current and in case that the capacitor (C100) (such as a bipolar capacitor) is used as the first impedance component, the output current is then limited by the capacitive impedance;

the first impedance (Z101), the second impedance (Z102) and the bi-directional conducting light emitting diode set (L100) are connected according to the aforesaid circuit structure to constitute the bi-directional light emitting diode drive circuit (U100).

3. A bi-directional light emitting diode drive circuit in bi-directional power parallel resonance as claimed in claim 1, wherein by means of the current distribution effect formed by the parallel connection of the bi-directional conducting light emitting diode set (L100) and the second impedance (Z102), the voltage variation rate across the two ends of the bi-directional conducting light emitting diode set (L100) corresponding to power source voltage variation can be reduced.

4. A bi-directional light emitting diode drive circuit in bi-directional power parallel resonance as claimed in claim 1, wherein the first impedance (Z101) can also be selected not to use, instead of that, the second impedance (Z102) which is in parallel resonance with the bi-directional power from power source is directly parallel connected with the power source of bi-directional power.

5. A bi-directional light emitting diode drive circuit in bi-directional power parallel resonance as claimed in claim 1, wherein either the first light emitting diode (LED101) or the second light emitting diode (LED102) can be replaced by a diode (CR100), wherein the current direction of the said (CR100) and the working current direction of either the first light emitting diode (LED101) or the second light emitting diode (LED102) which is reserved for parallel connection are in parallel connection of opposite polarities.

6. A bi-directional light emitting diode drive circuit in bi-directional power parallel resonance as claimed in claim 1, wherein if the first light emitting diode (LED101) and the second light emitting diode (LED102) constituting the bi-directional conducting light emitting diode set (L100) are simultaneously installed with the current limit resistors (R103) and (R104), the bi-directional conducting light emitting diode set (L100) can be replaced by or installed together with a current limit resistor (R100) to obtain the current limit function, wherein the current limit resistor (R100) can also be replaced by an inductive impedance component (I100); the bi-directional light emitting diode drive circuit (U100) is thus constituted by the said circuit structure and selection of auxiliary circuit components.

7. A bi-directional light emitting diode drive circuit in bi-directional power parallel resonance as claimed in claim 1, wherein a zener diode can be further parallel connected across the two ends of the first light emitting diode (LED101) and the second light emitting diode (LED102) in the bi-directional conducting light emitting diode set (L100), or the zener diode is first series connected with at least one diode to produce a zener voltage function, then parallel connected across the two ends of the first light emitting diode (LED101) or of the second light emitting diode (LED102); wherein:

a zener diode (ZD101) is parallel connected across the two ends of the first light emitting diode (LED101) of the bi-directional conducting light emitting diode set (L100), wherein its polarity relationship is that the zener voltage of the zener diode (ZD101) is used to limit the working voltage across the two ends of the first light emitting diode (LED101);

said zener diode (ZD101) is configured to be series connected with a diode (CR201) as needed, wherein the advantages are 1) the zener diode (ZD101) can be protected from reverse current; 2) both diode (CR201) and zener diode (ZD101) have temperature compensation effects;

if the second light emitting diode (LED102) is selected to consitute the bi-directional conducting light emitting diode set (L100), a zener diode (ZD102) can be selected to parallel connect across the two ends of the second light emitting diode (LED102), wherein their polarity relationship is that the zener voltage of the zener diode (ZD102) is used to limit the working voltage across the two ends of the second light emitting diode (LED102);

said zener diode (ZD102) is configured to be series connected with a diode (CR202) as needed, wherein the advantages are 1) the zener diode (ZD102) can be protected from reverse current; 2) both diode (CR202) and zener diode (ZD102) have temperature compensation effects.

8. A bi-directional light emitting diode drive circuit in bi-directional power parallel resonance as claimed in claim 1, wherein if the bi-directional conducting light emitting diode set (L100) in the bi-directional light emitting diode drive circuit (U100) is selected to be constituted by the first light emitting diode (LED101) and the second light emitting diode (LED102) in parallel connection of opposite polarities, its constitutions include the following:

a zener diode (ZD101) is configured to be parallel connected as needed across the two ends of the first light emitting diode (LED101) or a zener diode (ZD102) is configured to be parallel connected as needed across the two ends of the second light emitting diode (LED102), wherein their polarity relationships are that the zener voltage of the zener diode (ZD101) is used to limit the working voltage across the two ends of the first light emitting diode (LED101), and the zener voltage of the zener diode (ZD102) is used to limit the working voltage across the two ends of the second light emitting diode (LED102).

9. A bi-directional light emitting diode drive circuit in bi-directional power parallel resonance as claimed in claim 1, wherein the zener diode includes the following:

1) a zener diode (ZD101) is parallel connected across the two ends of the first light emitting diode (LED101) of the bi-directional conducting light emitting diode set (L100), and a zener diode (ZD102) is parallel connected across the two ends of the second light emitting diode (LED102); or 2) the two zener diodes (ZD101) and (ZD102) are reversely series connected and are further parallel connected across the two ends of the bi-directional conducting light emitting diode set (L100); or 3) it can be replaced by parallel connecting a diode with bi-directional zener effect in the circuit of bi-directional conducting light emitting diode set (L100).

10. A bi-directional light emitting diode drive circuit in bi-directional power parallel resonance as claimed in claim 1, wherein the first light emitting diode (LED101) can be installed with a charge/discharge device (ESD101), or the second light emitting diode (LED102) can be installed with a charge/discharge device (ESD102), wherein the charge/discharge device (ESD101) and the charge/discharge device (ESD102) have the random charging or discharging characteristics which can stabilize the lighting stability of the first light emitting diode (LED101) and the second light emitting diode (LED102), to reduce their lighting pulsations; the aforesaid charge/discharge devices (ESD101), (ESD102) can be constituted by the conventional charging and discharging batteries, or super-capacitors or capacitors.

11. A bi-directional light emitting diode drive circuit in bi-directional power parallel resonance as claimed in claim 1, wherein the application circuit with additionally installed charge/discharge device includes a charge/discharge device (ESD101) can be parallel connected across the two ends of the current limit resistor (R103) and the first light emitting diode (LED101) in series connection;

or a charge/discharge device (ESD102) can be further parallel connected across the two ends of the current limit resistor (R104) and the second light emitting diode (LED102) in series connection.

12. A bi-directional light emitting diode drive circuit in bi-directional power parallel resonance as claimed in claim 1, wherein the constitution of the application circuit with a charge/discharge device parallel connected across the two ends of the first and second light emitting diodes and the current limit resistor in series connection includes:

a charge/discharge device (ESD101) based on its polarity is parallel connected across the two ends of the first light emitting diode (LED101) and the current limit resistor (R103) in series connection, or is directly parallel connected across the two ends of the first light emitting diode (LED101), wherein the charge/discharge device (ESD101) has the random charge/discharge characteristics to stabilize the lighting operation and to reduce the lighting pulsation of the first light emitting diode (LED101);

if the second light emitting diode (LED102) is selected to use, a charge/discharge device (ESD102) based on its polarity is parallel connected across the two ends of the second light emitting diode (LED102) and the current limit resistor (R104) in series connection, wherein the charge/discharge device (ESD102) has the random charge/discharge characteristics to stabilize the lighting operation and to reduce the lighting pulsation of the second light emitting diode (LED102);

if a first light emitting diode (LED101) is selected and is reversely parallel connected with a diode (CR100) in the bi-directional light emitting diode drive circuit (U100), then its main circuit structure is that a charge/discharge device (ESD101) based on its polarity is parallel connected across the two ends of the first light emitting diode (LED101) and the current limit resistor (R103) in series connection, wherein the charge/discharge device (ESD101) has the random charge/discharge characteristics to stabilize the lighting operation and to reduce the lighting pulsation of the first light emitting diode (LED101);

the aforesaid charge/discharge devices (ESD101), (ESD102) can be constituted by the conventional charging and discharging batteries, or super-capacitors or capacitors.

13. A bi-directional light emitting diode drive circuit in bi-directional power parallel resonance as claimed in claim 1, wherein in the bi-directional light emitting diode drive circuit (U100), when the current limit resistor (R100) is selected to replace the current limit resistors (R103), (R104) to serve as the common current limit resistor of the bi-directional conducting light emitting diode set (L100) in the light emitting diode drive circuit (U100), the main circuit structure includes:

a charge/discharge device (ESD101) is directly parallel connected across the two ends of the first light emitting diode (LED101) of the same polarity, and a charge/discharge device (ESD102) is directly parallel connected across the two ends of the first light emitting diode (LED102) of the same polarity, wherein the charge/discharge devices (ESD101) and (ESD102) has the random charge or discharge characteristics;

the aforesaid charge/discharge devices (ESD101), (ESD102) can be constituted by the conventional charging and discharging batteries, or super-capacitors or capacitors.

14. A bi-directional light emitting diode drive circuit in bi-directional power parallel resonance as claimed in claim 1, wherein a charge/discharge device can be further installed across the two ends of the bi-directional conducting light emitting diode set (L100) for random charging/discharging, thereby besides of stabilizing the lighting stabilities of the first light emitting diode (LED101) and the second light emitting diode (LED102) of the bi-directional conducting light emitting diode set (L100), the charge/discharge device can provide its saving power during a power off to drive at least one of the first light emitting diode (LED101)or the second light emitting diode (LED102) to continue emitting light;

if the charge/discharge devices (ESD101) or (ESD102) used is uni-polar, after the first light emitting diode (LED101) is parallel connected with the uni-polar charge/discharge device (ESD101), a diode (CR101) of forward polarity series connection is configured to be installed as needed to prevent reverse voltage from damaging the uni-polar charge/discharge device; wherein after the second light emitting diode (LED102) is parallel connected with the uni-polar charge/discharge device (ESD102), a diode (CR102) of forward polarity series connection is configured to be installed as needed to prevent reverse voltage from damaging the uni-polar charge/discharge device;

the aforesaid charge/discharge devices (ESD101), (ESD102) can be constituted by the conventional charging and discharging batteries, or super-capacitors or capacitors.

15. A bi-directional light emitting diode drive circuit in bi-directional power parallel resonance as claimed in claim 1, wherein the bi-directional conducting light emitting diode set (L100), in which the lighting functions of the said bi-directional light emitting diodes are constituted by that a diode (CR101) is parallel connected with at least one first light emitting diode (LED101) in opposite polarities, and a diode (CR102) is parallel connected with at least one second light emitting diode (LED102) in opposite polarities, wherein the two are further reversely series connected to constitute a bi-directional conducting light emitting diode set.

16. A bi-directional light emitting diode drive circuit in bi-directional power parallel resonance as claimed in claim 1, wherein in the bi-directional light emitting diode drive circuit (U100), it is configured to be installed with one bi-directional conducting light emitting diode set (L100), or more than one set of the bi-directional conducting light emitting diode sets (L100) in series connection, parallel connection or in series and parallel connection, wherein if one set or more than one sets are selected to be installed, they can be driven together by the divided power at a common second impedance (Z102) or driven individually by the corresponding divided power at each of the multiple second impedances (Z102) which are in series connection or parallel connection.

17. A bi-directional light emitting diode drive circuit in bi-directional power parallel resonance as claimed in claim 1, wherein if the charge/discharge device is not installed, then current conduction to light emitting diode is intermittent, referring to the input voltage wave shape and duty cycle of current conduction, the light emitting forward current and the peak of light emitting forward voltage of each light emitting diode in the bi-directional conducting light emitting diode set (L100) can be correspondingly selected for the light emitting diodes;

if current conduction to light emitting diode is intermittent, the peak of light emitting forward voltage can be correspondingly selected based on the duty cycle of current conduction as long as the principle of that the peak of light emitting forward voltage does not damage the light emitting diode is followed.

18. A bi-directional light emitting diode drive circuit in bi-directional power parallel resonance as claimed in claim 1, wherein if the charge/discharge device is not installed, then based on the value and wave shape of the aforesaid light emitting forward voltage, the corresponding current value and wave shape from the forward voltage vs. forward current ratio are produced; however the peak of light emitting forward current shall follow the principle not to damage the light emitting diode.

19. A bi-directional light emitting diode drive circuit in bi-directional power parallel resonance as claimed in claim 1, wherein it is series connected to the bi-directional power modulator of series connection type, wherein the bi-directional power modulator of series connection type includes the following:

A bi-directional power modulator of series connection type (300) including conventional electromechanical components or solid state power components and related electronic circuit components to modulate the bi-directional power output;

the circuit operating functions are the following:

1) the bi-directional power modulator of series connection type (300) is series connected with the bi-directional light emitting diode drive circuit (U100) to receive the bi-directional power from power source, the bi-directional power is modulated by the bi-directional power modulator of series connection type (300) to execute power modulations such as pulse width modulation or current conduction phase angle control, or impedance modulation to drive the bi-directional light emitting diode drive circuit (U100); or 2) the bi-directional power modulator of series connection type (300) is series connected between the second impedance (Z102) and the bi-directional conducting light emitting diode set (L100) whereby the bi-directional divided power in parallel resonance across the two ends of the second impedance (Z102) is modulated by the bi-directional power modulator of series connection type (300) to execute power modulations such as pulse width modulation or current conduction phase angle control, or impedance modulation to drive the bi-directional conducting light emitting diode set (L100).

20. A bi-directional light emitting diode drive circuit in bi-directional power parallel resonance as claimed in claim 1, wherein it is parallel connected to a bi-directional power modulator of parallel connection type, wherein the bi-directional power modulator of parallel connection type includes the following:

a bi-directional power modulator of parallel connection type (400) including conventional electromechanical components or solid state power components and related electronic circuit components to modulate the bi-directional power output;

the circuit operating functions are the following:

1) the bi-directional power modulator of parallel connection type (400) is installed, wherein its output ends are for parallel connection with the bi-directional light emitting diode drive circuit (U100), while its input ends are provided for receiving the bi-directional power from the power source, the bi-directional power is modulated by the bi-directional power modulator of parallel connection type (400) to execute power modulations such as pulse width modulation or current conduction phase angle control, or impedance modulation to drive the bi-directional light emitting diode drive circuit (U100); or 2) the bi-directional power modulator of parallel connection type (400) is installed, wherein its output ends are parallel connected with the input ends of the bi-directional conducting light emitting diode set (L100) while its input ends are parallel connected with the second impedance (Z102), the bi-direction divided power in parallel resonance across the two ends of the second impedance (Z102) is modulated by the bi-directional power modulator of parallel connection type (400) to execute power modulations such as pulse width modulation or current conduction phase angle control, or impedance modulation to drive the bi-directional conducting light emitting diode set (L100).

21. A bi-directional light emitting diode drive circuit in bi-directional power parallel resonance as claimed in claim 1, wherein it is driven by a DC to AC inverter output power;

wherein:

a DC to AC Inverter (4000) includes conventional electromechanical components or solid state power components and related electronic circuit components, wherein its input ends are optionally provided as needed to receive input from a constant or variable voltage DC power, or a DC power rectified from an AC power, while its output ends are optionally selected as needed to supply bi-directional AC power of bi-directional sinusoidal wave, or bi-directional square wave or bi-directional pulse wave in a constant or variable voltage and constant or variable alternated polarity frequency or periods to be used as the power source to supply bi-directional power;

the circuit operating functions are the following:

the bi-directional light emitting diode drive circuit (U100) is parallel connected across the output ends of the conventional DC to AC inverter (4000); the input ends of the DC to AC inverter (4000) are optionally provided as needed to receive input from a constant or variable voltage DC power, or a DC power rectified from an AC power;

the output ends of the DC to AC inverter (4000) is configured to be selected as needed to provide power of bi-directional sinusoidal wave, or bi-directional square wave, or bi-directional pulse wave in a constant or variable voltage and constant or variable alternated period, wherein it can be further supplied to the two ends of the first impedance (Z101) and the second impedance (Z102) of the bi-directional light emitting diode drive circuit (U100) in series connection, wherein the divided power across the two ends of the second impedance (Z102) is then used to transmit to the bi-directional conducting light emitting diode set (L100);

in addition, the bi-directional light emitting diode drive circuit (U100) can be controlled and driven by means of modulating the output power from the DC to AC inverter (4000), as well as by executing power modulations to the power outputted such as pulse width modulation, or conductive current phase angle control, or impedance modulation.

22. A bi-directional light emitting diode drive circuit in bi-directional power parallel resonance as claimed in claim 1, wherein the bi-directional light emitting diode drive circuit (U100) which is arranged to be series connected with at least one conventional impedance component (500) and further to be parallel connected with the power source, wherein the impedance (500) includes:

1) a component with resistive impedance characteristics; or
2) a component with inductive impedance characteristics; or
3) a component with capacitive impedance characteristics; or
4) a single impedance component with the combined impedance characteristics of at least two of the resistive impedance, or inductive impedance, or capacitive impedance simultaneously, thereby to provide DC or AC impedances; or
5) a single impedance component with the combined impedance characteristics of inductive impedance and capacitive impedance, wherein its inherent parallel resonance frequency is the same as the frequency or period of bi-directional power from power source, thereby to produce a parallel resonance status; or
6) one kind or more than one kind of one or more than ones capacitive impedance component, or inductive impedance component, or resistive impedance component or by two kinds or more than two kinds of impedance components in series connection, or parallel connection, or series and parallel connection so as to provide DC or AC impedances; or
7) the mutual series connection of a capacitive impedance component and an inductive impedance component, wherein its inherent series resonance frequency is the same as the frequency or period of bi-directional power from power source to produce a series resonance status and the end voltage across two ends of the capacitive impedance component or the inductive impedance component appear in series resonance correspondingly;

or the capacitive impedance and the inductive impedance are in mutual parallel connection, its inherent parallel resonance frequency is the same as the frequency or period of bi-directional power from power source, thereby to produce a parallel resonance status and appear the corresponding end voltage.

23. A bi-directional light emitting diode drive circuit in bi-directional power parallel resonance as claimed in claim 1, wherein the optionally installed inductive impedance component (I200) of the second impedance (Z102) can be further replaced by the power supply side winding of a transformer with inductive effect, wherein the self-coupled transformer (ST200) has a self-coupled voltage change winding (WO) with voltage raising function, the b, c ends of the self-coupled voltage change winding (WO) of the self-coupled transformer (ST200) are the power supply side which replace the inductive impedance component (I200) of the second impedance (Z102) to be parallel connected with the capacitor (C200), wherein its inherent parallel resonance frequency after parallel connection is the same as the frequency of the bi-directional power source such as the frequency of an Ac power, or the alternated polarity period of the constant or variable voltage and the constant or variable periodically alternated polarity power converted from a DC power to appear in a parallel resonance status, thereby to constitute the second impedance (Z102) which is series connected with the capacitor (C100) of the first impedance (Z101), further, the capacitor (C200) is configured to be parallel connected with the a, c taps or b, c taps of the self-coupled transformer (ST200), or other selected taps as needed, wherein the a, c output ends of the self-coupled voltage change winding (WO) of the self-coupled transformer (ST200) are arranged to provide AC power of voltage rise to drive the bi-directional conducting light emitting diode set (L100).

24. A bi-directional light emitting diode drive circuit in bi-directional power parallel resonance as claimed in claim 1, wherein the optionally installed inductive impedance component (I200) of the second impedance (Z102) can be further replaced by the power supply side winding of a transformer with inductive effect, wherein the self-coupled transformer (ST200) has a self-coupled voltage change winding (W0) with voltage drop function, in which the b, c ends of the self-coupled voltage change winding (W0) of the self-coupled transformer (ST200) are the power supply side which replace the inductive impedance component (I200) of the second impedance (Z102) to be parallel connected with the capacitor (C200), wherein its parallel resonance frequency after parallel connection is the same as the frequency of the bi-directional power source such as the frequency of an AC power, or the alternated polarity period of the constant or variable voltage and the constant or variable periodically alternated polarity power converted from a DC power to appear in a parallel resonance status, thereby to constitute the second impedance (Z102), which is series connected with the capacitor (C100) of the first impedance (Z101), further, the capacitor (C200) is configured to be parallel connected with the a, c taps or b, c taps of the self-coupled transformer (ST200), or other selected taps as needed, wherein the a, c output ends of the self-coupled voltage change winding (W0) of the self-coupled transformer (ST200) are arranged to provide AC power of voltage drop to drive the bi-directional conducting light emitting diode set (L100).

25. A bi-directional light emitting diode drive circuit in bi-directional power parallel resonance as claimed in claim 1, wherein the optionally installed inductive impedance component (I200) of the second impedance (Z102) can be further replaced by the power supply side winding of a transformer with inductive effect, wherein the separating type transformer (IT200) is comprised of a primary side winding (W1) and a secondary side winding (W2), in which the primary side winding (W1) and the secondary side winding (W2) are separated, while the primary side winding (W1) is parallel connected with the capacitor (C200), wherein their inherent parallel resonance frequency after parallel connection is the same as the frequency of the bi-directional power source such as the frequency of an AC power, or the alternated polarity period of the constant or variable voltage and the constant or variable periodically alternated polarity power converted from a DC power to appear in a parallel resonance status, thereby to constitute the second impedance (Z102) which is series connected with the capacitor (C100) of the first impedance (Z101), and the capacitor (C200) is configured to be parallel connected with the a, c taps or b, c taps of the self-coupled transformer (ST200), or other selected taps as needed; the output voltage of the secondary side winding (W2) of the separating type transformer (IT200) is configured to be selected as needed to provide AC power of voltage rise or voltage drop to drive the bi-directional conducting light emitting diode set (L100);

the inductive impedance component (I200) of the second impedance (Z102) is replaced by the power supply side winding of the transformer and is parallel connected with the capacitor (C200) to appear parallel resonance, thereby to constitute the second impedance (Z102), while the secondary side of the separating type transformer (IT200) provides AC power of voltage rise or voltage drop to drive the bi-directional conducting light emitting diode set (L100).

* * * * *